US007052563B2

(12) United States Patent
Dong et al.

(10) Patent No.: US 7,052,563 B2
(45) Date of Patent: May 30, 2006

(54) APPARATUS AND METHOD FOR FIBER BATT ENCAPSULATION

(75) Inventors: Daojie Dong, Westerville, OH (US); Timothy D Schoenenberger, Granville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 186 days.

(21) Appl. No.: 10/732,760

(22) Filed: Dec. 10, 2003

(65) Prior Publication Data

US 2005/0126677 A1 Jun. 16, 2005

(51) Int. Cl.
*B32B 5/26* (2006.01)
*B32B 31/30* (2006.01)
*B32B 19/06* (2006.01)

(52) U.S. Cl. ..... 156/62.4; 156/167; 156/279; 428/74; 428/76; 427/180

(58) Field of Classification Search ..... 428/74
See application file for complete search history.

(56) References Cited

U.S. PATENT DOCUMENTS 3,955,031 A * 5/1976 Jones et al. ..... 442/412
5,240,527 A * 8/1993 Lostak et al. ..... 156/62.4
5,501,872 A 3/1996 Allen et al.
5,582,905 A * 12/1996 Beck et al. ..... 428/74
5,876,529 A 3/1999 Grant et al.
5,900,206 A 5/1999 Pellegrin et al.
5,983,586 A 11/1999 Berdan, II et al.
6,113,818 A 9/2000 Pellegrin et al.
6,135,746 A 10/2000 Syme et al.
6,191,057 B1 * 2/2001 Patel et al. ..... 442/398
6,203,646 B1 3/2001 Gundberg et al.
6,207,738 B1 * 3/2001 Zuckerman et al. ..... 524/156
6,436,471 B1 8/2002 Petersen
6,517,648 B1 * 2/2003 Bouchette et al. ..... 156/62.4
2003/0061776 A1 * 4/2003 Alderman ..... 52/404.1
2003/0119410 A1 * 6/2003 Bodaghi ..... 442/400
2004/0118506 A1 6/2004 Dong

FOREIGN PATENT DOCUMENTS

WO WO 98/54387 12/1998
WO WO 98/54388 12/1998
WO WO 03/040453 5/2003

* cited by examiner

*Primary Examiner*—Sam Chuan Yao
(74) *Attorney, Agent, or Firm*—Inger H. Eckert; Maria C. Gasaway

(57) ABSTRACT

Disclosed is an apparatus and a method for at least partially encapsulating a fiber batt or other substrate by applying a polymer fiber layer to one or more surfaces of the fiber batt or substrate by melt-blowing. The melt-blowing assemblies are arranged and configured to extrude both a polymer melt and a hot gas stream whereby the hot gas stream attenuates the polymer melt to form polymer melt fibers and to direct the polymer melt fibers toward a surface to be coated. The melt-blowing assemblies are further of the fiber batt. A combination of melt-blowing assemblies may be provided in either fixed or moveable configurations for coating one or more sides of the fiber batt.

23 Claims, 21 Drawing Sheets

APPARATUS AND METHOD FOR FIBER BATT ENCAPSULATION

BACKGROUND OF THE INVENTION

1. Technical Field and Industrial Applicability of the Invention

The present invention relates to an apparatus for applying a polymer coating to a substrate, typically a fiber batt, in order to encapsulate the substrate. The encapsulation may be partial or complete and may be applied in combination with other films, sheet materials and facing materials as desired.

2. Background of the Invention

Fibrous insulation is typically manufactured by fiberizing a molten composition of polymer, glass or other minerals to form fine fibers and depositing the fibers on a collecting conveyor to form a batt or a blanket. Although mineral fibers, such as glass fibers, are typically used in insulation products, depending on the particular application organic fibers, such as polypropylene and polyester may be used singly or in combination with mineral fibers.

Most fibrous insulation products also incorporate a binder composition to bond the fibers together where they contact each other within the batt or sheet to form a lattice or network. This lattice structure provides improved resiliency that allows the insulation product to recover a substantial portion of its thickness after being compressed and also provides improved stiffness and handleability. During the manufacturing process the insulation products are typically formed and cut to provide sizes generally compatible with standard construction practices. Some insulation products also incorporate a facing or encapsulating material on at least one of the major surfaces to improve the performance and/or the handling of the batt. In many cases the facing or encapsulating material includes a vapor barrier on at least one major surface, while in other insulation products, such as binderless products, the facing or encapsulating material may significantly improve the product integrity and durability.

Insulation products incorporating a vapor barrier are commonly used to insulate wall, floor or ceiling cavities that separate a warm moist space, typically the living or work spaces, from a cold space, typically the exterior, crawl space, or ground. In such applications, the vapor barrier is preferably placed to prevent warm moist air from diffusing toward the cold space where it would cool and condense within the insulation. Such a situation would result in a damp insulation product that cannot perform at its designed efficiency and may lead to microbial growth within the insulation resulting in health or aesthetic concerns. In predominately warm moist climates, however, it is not uncommon to reverse the typical installation in order to prevent vapor from entering the insulation cavity and approaching an air conditioned space.

There are, however, some applications that require an insulation product that does not incorporate or provide a vapor barrier, but rather allows water vapor to pass through fairly readily. For example, insulation products designed and intended for installation over existing attic insulation should not include a vapor barrier. Similarly, insulation products for wall cavities that have a separate full wall vapor barrier, such as a polyethylene film, applied over the insulation product.

A number of methods for encapsulating fibrous batts for improved handling properties are known. For example, U.S. Pat. No. 5,277,955 to Schelhorn et al. discloses an encapsulated batt in which the encapsulation material is adhered to the batt with an adhesive that can be applied in longitudinal stripes, or in patterns such as dots, or in an adhesive matrix. The Schelhorn patent also discloses that an alternative method of attachment is for the adhesive layer to be an integral part of the encapsulation layer, which, when softened, bonds to the fibers in the batt and is hereby incorporated, in its entirety, by reference.

U.S. Pat. No. 5,733,624 to Syme et al. discloses a mineral fiber batt impregnated with a coextruded polymer layering system, and U.S. Pat. No. 5,746,854 to Romes et al. discloses a method for impregnating a mineral fiber batt with a coextruded film in which at least the coextruded film is heated before being applied to the fiber batt. The heat energy necessary to achieve the necessary degree of heating may be transferred primarily by conduction the coextruded film passes over a heated cylinder or through radiant infrared heaters. Attaching the coextruded film in this manner has some disadvantages in that the particular heating process cannot be abruptly terminated or quickly varied due to the large thermal mass provided by the heated cylinder. In addition, the heated cylinder does not provide a means for selectively heating portions of the coextruded film to different temperatures. These patents are hereby incorporated, in their entirety, by reference.

Many traditional vapor barriers for insulation products comprised a layer of asphalt covered with a layer of kraft paper or a foil facing material. The asphalt layer was generally applied in molten form, covered with the facing material and pressed against the fibrous insulation material as it was cooled to bond the facing material to the fibrous batt. During cold weather installations, working with an asphalt/kraft paper faced fiber batt may be complicated by the increased brittleness of the asphalt adhesive layer. Conversely, during warm weather installations, the asphalt material will tend to soften and become sticky and more likely to foul cutting tools.

U.S. Pat. No. 6,357,504 to Patel et al. provided an alternative means for attaching a facing layer to a fibrous batt in which the facing comprises a coextruded polymer film including both a barrier layer and a bonding layer, with the bonding layer having a softening point lower than the softening point of the barrier layer. The bonding layer could comprise a range of materials including ethylene N-butyl acrylate, ethylene methyl acrylate ethylene ethyl acrylate, low density polyethylene (LDPE) and ethylene vinyl acetate, both singularly and in combination. Accordingly, when the facing is heated to a temperature above the softening point of the bonding layer, but below the softening point of the barrier layer, the facing may be adhered to the batt as the bonding layer attaches to the fibers. This patent is hereby incorporated, in its entirely, by reference.

In addition to facing layers provided on one or more surfaces of a fibrous batt, some prior art applications provide for an encapsulating layer to improve the tactility of the insulation product during the handling and mounting, reduce or eliminate the release of fibers before, during or after mounting and improved tensile strength. One such method is disclosed in U.S. Pat. No. 6,203,646 to Gundberg et al. in which the encapsulating layer is formed directly on the surface of the fiber batt by forming a thermoplastic polymer melt distributing fibers formed from the polymer melt onto the fiber batt. In this method, the adhesive characteristics of the molten and partially molten thermoplastic polymers is used to adhere the layer to the underlying fibers without the use of any additional binder or adhesive composition. This patent is hereby incorporated, in its entirety, by reference.

Another method and apparatus for providing a melt blown encapsulating layer on a fiber batt is provided in U.S. Pat.

No. 5,501,872 to Allen et al. in which a six-sided fibrous batt is coated with a nonwoven polymeric material by passing the batt sequentially through three coating stations. Four sides of the batt are coated in the first two stations and, after the batt is turned 90°, the final two sides are coated to completely encapsulate the batt in a fibrous nonwoven coating layer. This patent is hereby incorporated, in its entirety, by reference.

There still, however, remains a need for improved methods for encapsulating insulation products to enhance their handling and performance encapsulation methods.

BRIEF SUMMARY OF THE INVENTION

The invention is directed, in part, to an apparatus and a method for manufacturing an insulation product comprising an elongated fibrous batt with a polymeric encapsulating layer and, optionally, a vapor barrier layer on one or more surfaces of the fibrous batt.

Exemplary embodiments of the apparatus accommodate a method of forming an encapsulated fiber batt comprising conveying a continuous fiber batt in at least a first direction, the fiber batt having two major surfaces, typically a top and bottom surface, and two minor or side surfaces with fiber batt oriented so that the major surfaces have a substantially horizontal orientation. The fiber batt is conveyed past at least one melt-blowing assembly, with each melt-blowing assembly being arranged and configured to extrude a polymer melt and a hot gas stream, the hot gas stream being utilized to attenuate the polymer melt to form polymer melt fibers and to direct the polymer melt fibers toward a surface of the fiber batt. A combination of melt-blowing assemblies may be provided in either fixed or moveable configurations for coating one or more sides of the fiber batt.

Each melt-blowing assembly will also be arranged and configured to apply a water mist to the polymer melt fibers to quench a surface portion of the polymer melt fibers before the polymer melt fibers contact the surface of the fiber batt while still allowing at least portions of the polymer melt fibers to remain at a temperature sufficient to establish good adhesion to the fiber batt or previously deposited polymer fibers. The polymer resin(s) utilized in the invention may be any resin or mixture of resins that have a melt flow index (MFI) suitable for melt-blowing including, for example, polypropylenes, polyethylenes, polyethylene terephthalates and nylons.

Another exemplary embodiment of the invention provides for the attachment of a facing or vapor retarding layer to one or more surfaces of the fiber batt after which the remaining surface(s) of the fiber batt may be coated with an encapsulating layer using the apparatus and methods described herein. The facing or vapor retarding layer may be attached to one of the major surfaces of the fiber batt and may be sized so as to extend beyond the perimeter of the major surface to provide attachment means for fiber batt installation or for covering additional portions of the fiber batt surface, particularly the minor surfaces.

The facing or vapor retarding layer may be attached to the fiber batt in any conventional manner, including, for example, applying a discontinuous layer or pattern of an adhesive to one surface of the vapor retarding layer and then forcing the first surface of the vapor retarding layer against a major surface of the fiber batt using rollers, belts or other devices capable of an application time period sufficient to allow the facing or vapor retarding layer to become adhered to the fiber batt by the adhesive. Hot-melt adhesives are generally suitable for such applications and may be applied by spraying, melt-blowing or other conventional means.

The foregoing and other objectives of the present invention will become more apparent from the detailed description provided below. However, it should be understood that the detailed description and specific examples, while indicating preferred embodiments of the invention, are given by way of illustration only, and that various changes and modifications within the spirit and scope of the invention will be apparent to those skilled in the art when guided by the detailed disclosure.

BRIEF DESCRIPTION OF THE DRAWINGS

The above and other features and advantages of the present invention will become more apparent by describing in detail preferred embodiments thereof with reference to the attached drawings in which.

These figures are for the purpose of illustration only and are not, therefore, drawn to scale. The relative sizing and orientation of the various structural elements may have been exaggerated, simplified and/or otherwise modified to improve the clarity of the drawings with respect to the written description and should not be interpreted as unduly limiting the scope of the invention.

DETAILED DESCRIPTION OF EXEMPLARY EMBODIMENTS

Figure 1A:
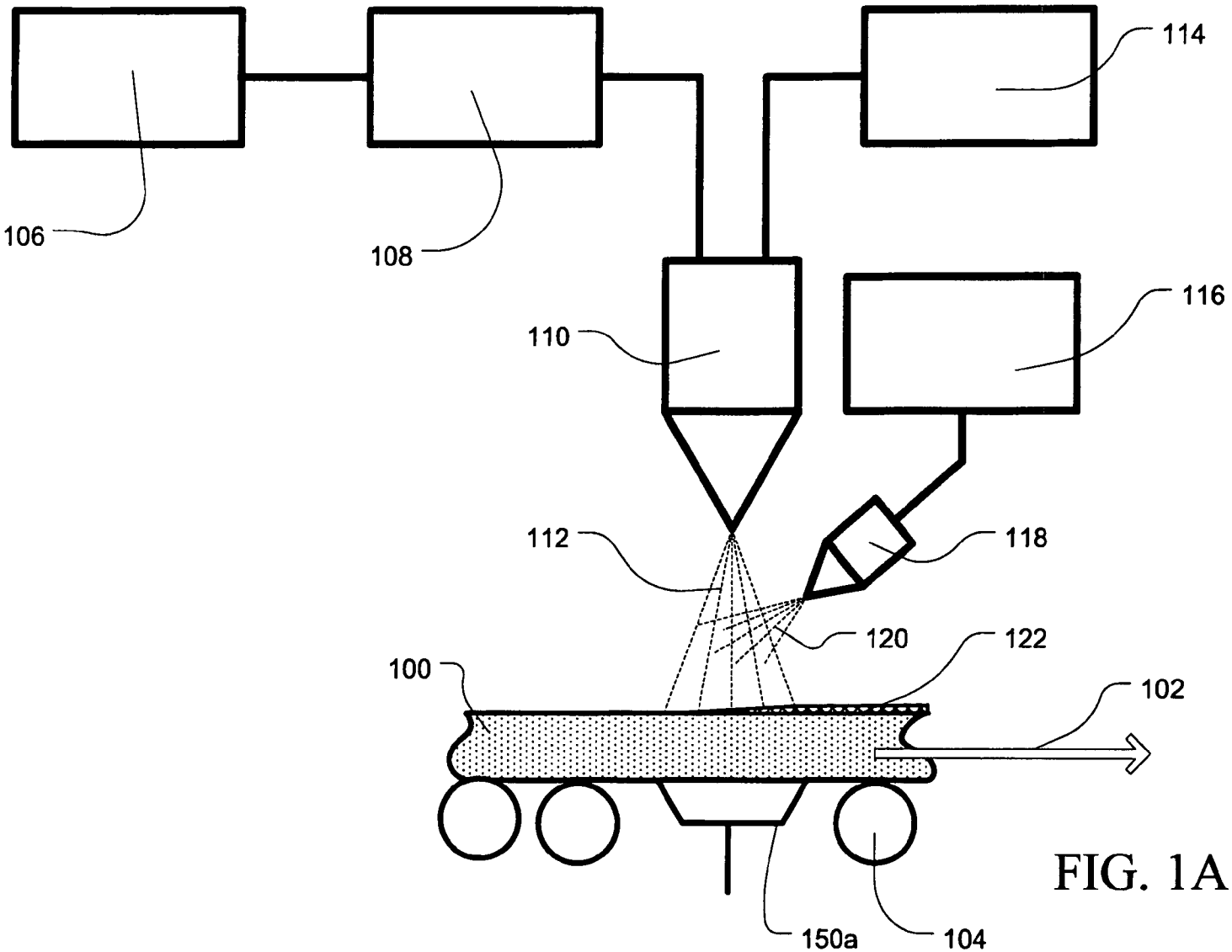
FIG. 1A illustrates an exemplary assembly for applying an encapsulating layer to a surface of a fiber batt or other substrate.

As illustrated in FIG. 1A, an exemplary embodiment of an apparatus for practicing the invention provides for the formation of an encapsulating layer on a surface of a fiber batt 100 or other substrate. The fiber batt 100 is conveyed through the apparatus in a direction 102 through the use of one or more types of conveying means such as rollers 104 or belts that can be configured to support and/or advance the fiber batt. The apparatus may also include a polymer resin reservoir, silo or other storage means 106 from which the polymer or polymer(s) may be delivered to an extruder 108 or other device for forming a polymer melt. A variety of polymer compositions may be utilized in the present invention including, for example, polypropylene (PP), polyethylene (PE), ethylene-propylene copolymer, polyester, polyethylene terephthalate (PET), nylon, ethylene/vinyl acetate (EVA) or any other polymer, copolymer, block copolymer or polymer prepared from more than two monomers that may be suitable for the intended product application, either singly or in a combination of two or more polymers. The polymer composition may also include virgin and/or recycled material.

The apparatus may also be arranged and configured to apply different materials and/or different layer thicknesses on different surfaces of the fiber batt to produce encapsulated batt products having a combination of properties that are desirable for particular manufacturing processes and/or final applications. For example, one or more major surfaces may be coated with a tough, generally impermeable layer that will resist cracking and delamination during rolling and compressing operations while the minor surfaces may be coated with a more permeable layer to permit gas to escape easily from the fiber batt as it is compressed and enhance thickness recovery during installation of the final product.

The polymer melt is then supplied to a melt-blowing die or head 110 which typically ejects or extrudes multiple streams of molten polymer that are then contacted with a blowing gas from a supply 114. The blowing gas, typically heated air, nitrogen or other gas is directed into the streams of molten polymer with a volume and intensity sufficient to attenuate, elongate and separate the streams of molten polymer into a fiber spray 112 comprising a plurality of polymer fibers that are directed toward a surface of the fiber batt 100. Depending on the melt-blowing conditions and the polymer composition, it is anticipated that typical polymer diameters will be within a range of from about 1 μm to perhaps 25 μm or more. Before the polymer fibers contact the surface of the fiber batt 100, a second nozzle 118 injects a cooling fluid 120 from a reservoir 116 or other supply into the polymer fiber spray 112.

As illustrated in FIG. 1A, the exemplary apparatus may also include one or more vacuum devices 150*a* that may be arranged and configured to draw the polymer fiber spray 112 toward the fiber batt 100 and/or remove air and/or overspray from the vicinity of the melt-blowing operation for the purpose of improving the process performance and/or the quality of the resulting encapsulating layers. A conventional application of vacuum devices will include one or more vacuum devices arranged adjacent an opposing surface of the fiber batt to draw gas through the fiber batt and improve the application of the material being applied to a main surface by melt-blowing or spraying. The vacuum devices, particularly in a partially closed apparatus, may help compensate for the volume of gas being introduced into the apparatus via the blowing gas and/or the vaporization of a cooling liquid.

The volume and composition of the cooling liquid is selected depending on the flow rate and thermal conditions of the polymer fiber spray to cause partial cooling or quenching of the polymer fibers before the fibers reach the surface of the fiber batt 100. Although the cooling fluid may be a gas, it is preferred that the cooling fluid is a mist of a cooling liquid containing a range of liquid particles or droplets of a size and composition so as to evaporate substantially completely before any residual portion of the liquid reaches the fiber batt 100 to avoid unnecessary wetting of the fiber batt. The size distribution of liquid droplets within the cooling mist 120 may be controlled to some extent by the particular type of spray means selected and the conditions under which the spray means is operated to provide a suitable size distribution for achieving the desired degree of cooling of the fiber spray 112. In some instances, the cooling fluid droplets may be sized so that a majority of the droplets are larger, smaller or approximately the same diameter as the average fiber included in the fiber spray 112.

Similarly, the orientation and spacing of the melt-blowing heads 110 and the second nozzles 118 both with respect to each other and the fiber batt 100 will affect the properties of the resulting encapsulating layer. Further, the melt-blowing heads 110 and the second nozzles 118 may be generally fixed with respect to the fiber batt 100 or may provide for a range of motion including one or more of linear, rotational, orbital, radial and/or angular displacement relative to the fiber batt and each other. Some relative motion of the melt-blowing heads 110 and the fiber batt 100 may be especially helpful in ensuring that corner regions of the fiber batt 100, i.e., the junction between adjacent surfaces, are coated to a sufficient degree.

Figure 1B:
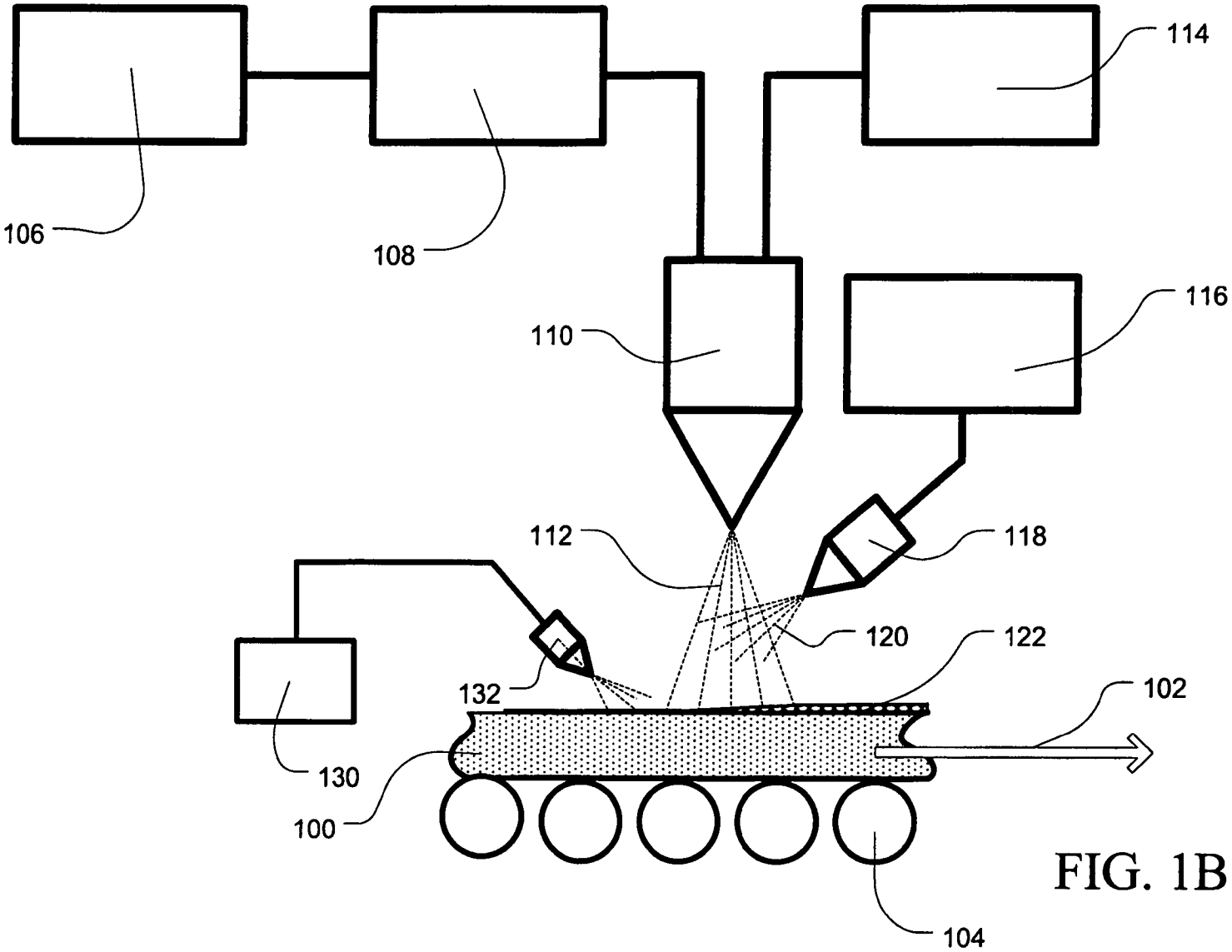
FIG. 1B illustrates an alternative embodiment of the basic assembly for applying an encapsulating layer to a surface of a fiber batt or other substrate.

As illustrated in FIG. 1B, an alternative embodiment of an apparatus for practicing the invention provides for the formation of an encapsulating layer on a surface of a fiber batt 100 or other substrate. The fiber batt 100 is conveyed through the apparatus in a direction 102 through the use of one or more types of conveying means such as rollers 104 or belts that can be configured to support and/or advance the fiber batt. The apparatus may also include a means for applying an adhesive or other pre-conditioning material(s) onto one or more surfaces of the fiber batt 100 before the melt-blown fibers are applied to the fiber batt surface. The adhesive or other material(s) may be delivered to a spray assembly 132, which may be configured as a melt-blowing or conventional spray assembly, that sprays one or more materials, such as a hot-melt adhesive, from a supply reservoir 130 onto a surface of the fiber batt 100 before or during the application of the spray of melt-blown fibers 112 to the surface of the fiber batt. Depending on the type and volume of the material(s) being applied to the fiber batt, the surface(s) of the fiber batt to which the material(s) are being applied, and the desired degree of penetration into the fiber batt, other application methods may be utilized including, for example, dipping, dripping, rolling, powder coating and/or dusting. In some instances, the use of an adhesive composition may reduce or eliminate the need to maintain a highly adhesive portion of the polymer fiber spray, thereby allowing additional quenching of the fiber through one or more methods such as an increased use of cooling liquid, more uniform mixing of the cooling liquid and the fiber spray, increasing the distance between the melt-blowing heads and the fiber batt surface and reducing or eliminating the need for a cooling fluid and thereby improve the strength, appearance and/or feel of the resulting fiber layer.

The additional materials may be used to modify the properties of one or more of the surface regions of the fiber batt to improve subsequent processing performance, improve the performance of the installed product and/or alter the appearance of the resulting product. For example, applying an adhesive composition to improve the adhesion of the melt-blown layer may allow improvements in the melt-blown layer strength (e.g., by permitting the use of more thoroughly quenched fibers) while suppressing cracking and delamination problems during subsequent bagging, increasing the strength of the resulting product, or providing different properties on selected surfaces of the fiber batt. Further, the additional materials may be applied in a continuous or discontinuous fashion and the discontinous applications may be random or may be applied in one or more repeating patterns.

Figure 2:
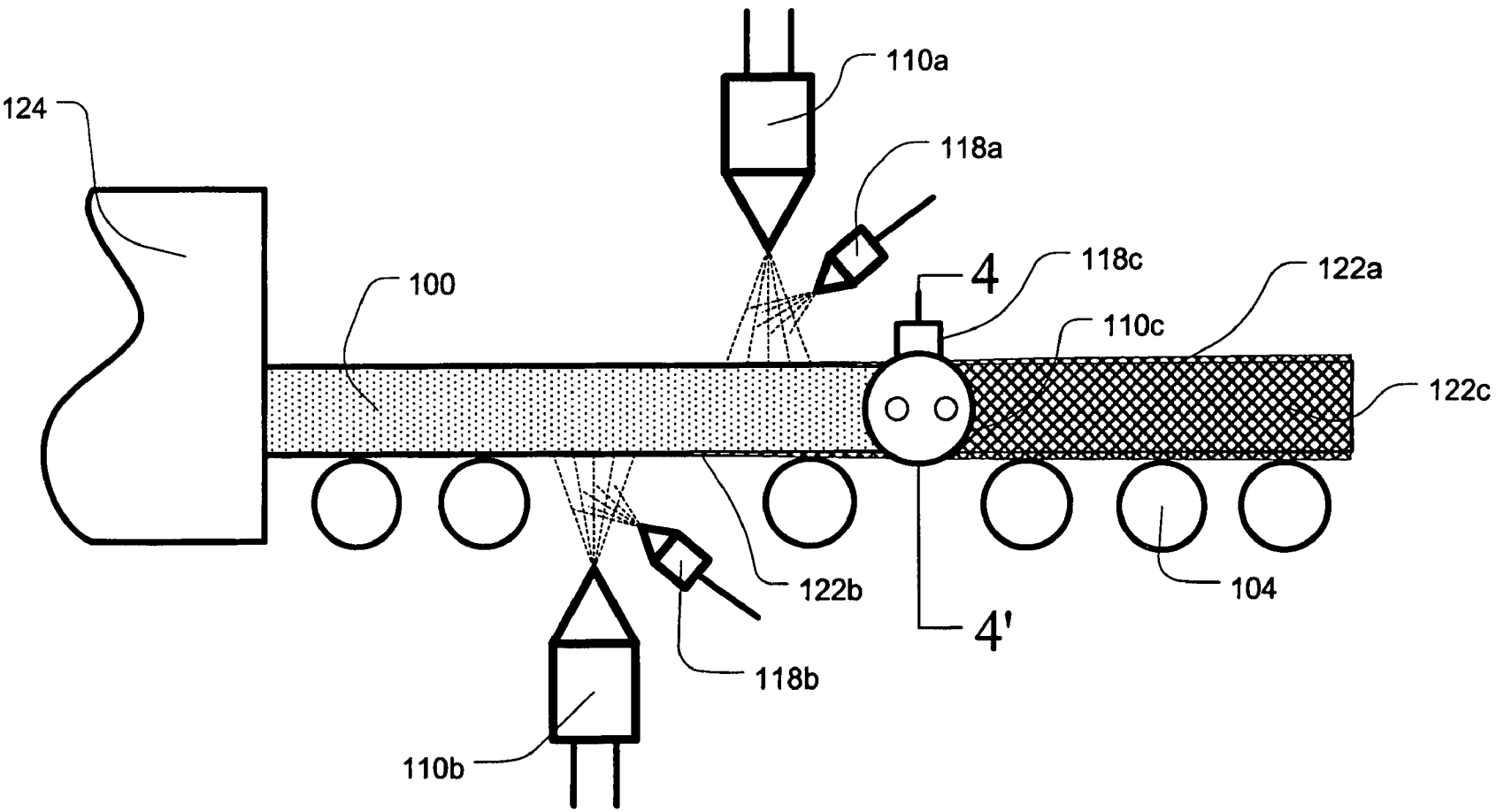
FIG. 2 illustrates an embodiment of the invention for applying an encapsulating layer to each of the exposed surfaces of a fiber batt.

As illustrated in FIG. 2, an exemplary embodiment of an apparatus according to the invention will typically receive a continuous fiber batt from an upstream apparatus 124 such as a curing oven used to cure a binder composition or a supply reservoir or roll of previously manufactured fiber batt. The fiber batt 100 will typically be conveyed from the upstream apparatus 124 and into the encapsulating apparatus or an encapsulating section of a larger apparatus. The major surfaces of the fiber batt 100 may be coated with the encapsulating layers either sequentially or simultaneously, but a sequential application is more typical and tends to improve the degree of control over the process.

As illustrated in FIG. 2, as the fiber batt 100 is conveyed from left to right an encapsulating layer is applied to the lower major surface through a first melt-blowing assembly 110*b*, 118*b*, an encapsulating layer is applied to the upper major surface through a second melt-blowing assembly 110*a*, 118*a*, and then encapsulating layers are applied to the minor side surfaces through third melt-blowing assemblies 110*c*, 118*c* and fourth melt-blowing assemblies (not shown). Although the application of the encapsulating layers to the opposite side surfaces is illustrated as substantially simultaneous, the melt-blowing assemblies for coating the minor surfaces may be offset from each other in the direction of batt movement and/or vertically if desired.

Figure 3:
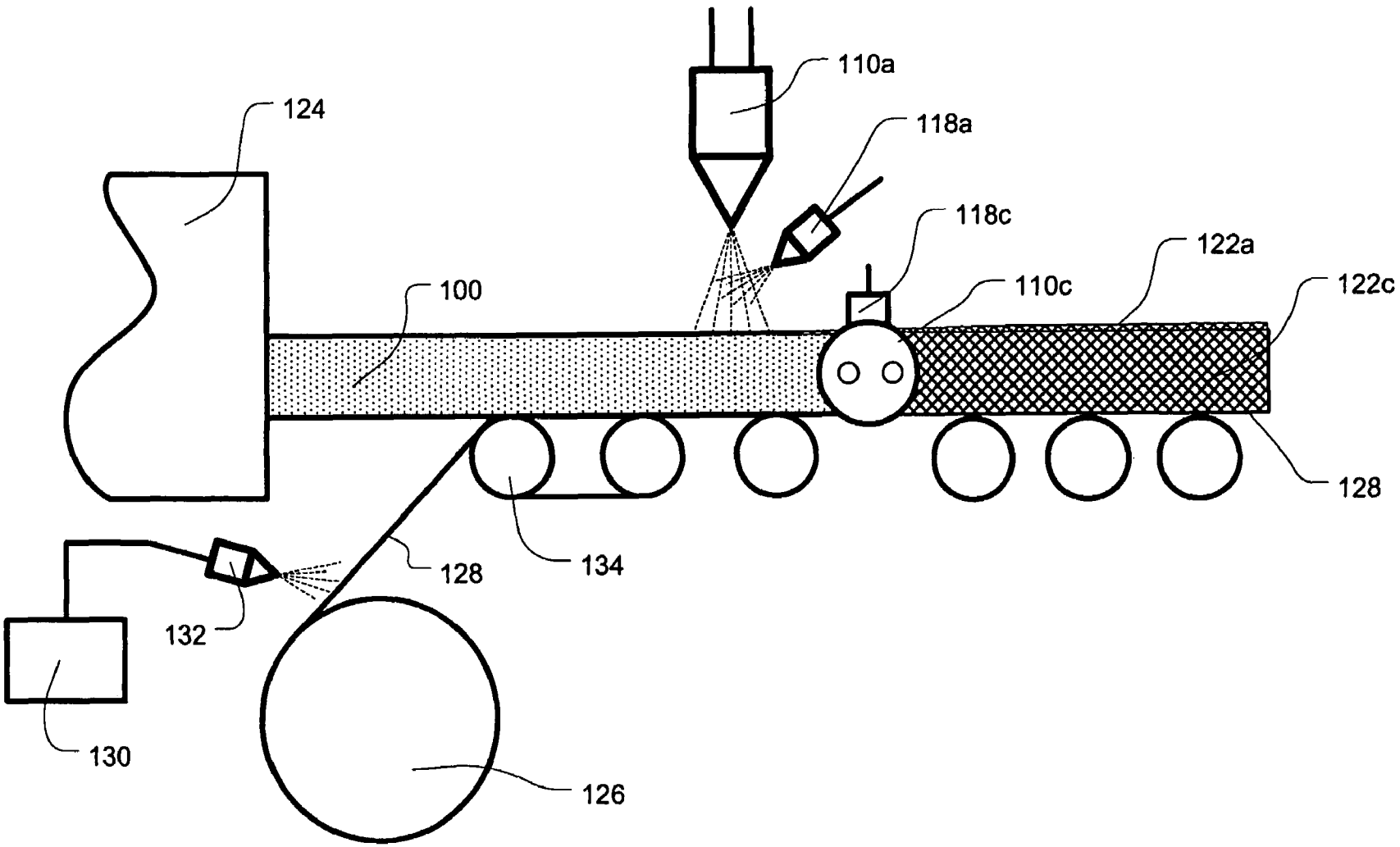
FIG. 3 illustrates an embodiment of the invention in which a premanufactured layer or film is applied to one surface of the fiber batt after which encapsulating layers are applied to the remaining surfaces.

As illustrated in FIG. 3, another exemplary embodiment of an apparatus according to the invention may be configured to apply a vapor retarding layer, vapor permeable layer or other facing material on one or more surfaces of the fiber batt 100. In the illustrated embodiment, a premanufactured sheet product such as a film, layer, or woven or non-woven fabric is prepared and arranged to be dispensed from a supply means 126 such as a roll or other storage means. The premanufactured sheet material 128 is then drawn from the supply means 126 and typically coated with a layer of adhesive which may be applied by contact or spraying means.

As illustrated in FIG. 3, the adhesive may be delivered to a spray assembly 132, which may be configured as a melt-blowing assembly, that sprays adhesive, such as a hot-melt adhesive, from an adhesive supply 130 onto a surface of the premanufactured sheet product 128. The adhesive-coated surface of the vapor retarding layer is then pressed against a surface of the fiber batt 100 for a period sufficient to allow the adhesive to bond the premanufactured sheet product to the fiber batt. The remaining surfaces of the fiber batt 100 may then be encapsulated with melt-blown polymer fibers as described above to complete the production of an encapsulated fiber batt. The fiber batt will then typically be cut (not shown) into sizes suitable for its intended application.

The premanufactured sheet product 128, may be selected from a wide variety of other layers, films, fabrics or substrates suitable for modifying one or more surfaces of the fiber batt 100 before the remaining surfaces are encapsulated with the melt-blown layer. The premanufactured sheet products may be selected from vapor retarding layers, decorative materials, conventional asphalt-coated kraft paper, kraft paper, spun-bonded films, layers or fabrics, pre-perforated or other permeable films.

Depending on the particular material(s) being applied to the fiber batt, they may be self-adhesive or, if a separate adhesive is required, it may be applied by a variety of known methods including spraying, rolling and/or dripping suitable for applying an adequate amount and pattern of adhesive to the premanufactured sheet product, thereby ensuring both a satisfactory bond to the underlying fiber batt and a modification of the properties of the original fiber batt. The properties modified may include, for example, strength, permeability to vapor and/or liquid, appearance, color and/or text such as trademarks, product designations or decorative patterns or images, particularly for exposed applications, feel, touch or handling safety.

Figure 4:
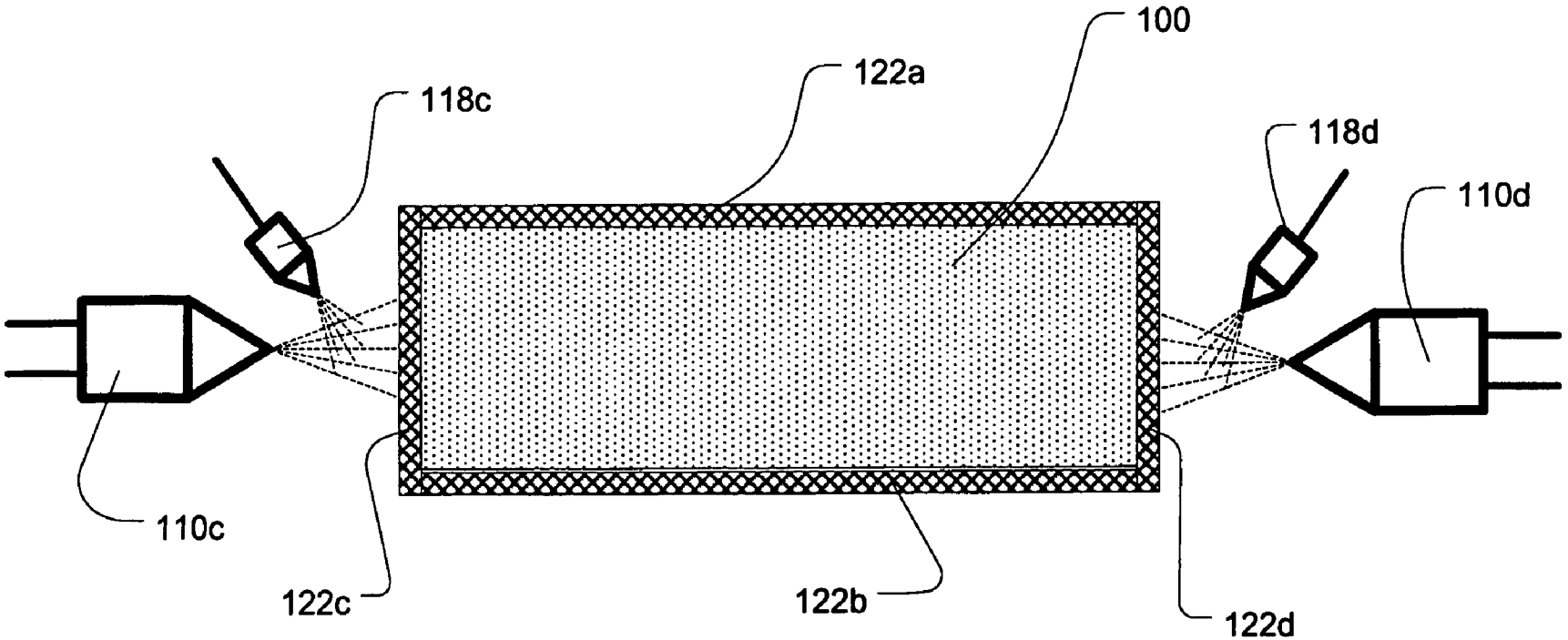
FIG. 4 illustrates a cross section along line 4–4' of the fiber batt illustrated in FIG. 2.

As illustrated in FIG. 4, the melt-blowing assemblies may be arranged adjacent both of the minor surfaces for forming encapsulating layers 122*c*, 122*d* on the minor surfaces of the fiber batt 100 and may be configured in a manner similar to that of the assemblies for forming the encapsulating layers 122*a*, 122*b* on the major surfaces. Each of the melt-blowing assemblies will include both a melt-blowing head 110*c*. 110*d* and a second nozzle 118*c*, 118*d* arranged for injecting a cooling fluid or mist 120 into the polymer fiber spray.

Figures 5A, 5B:
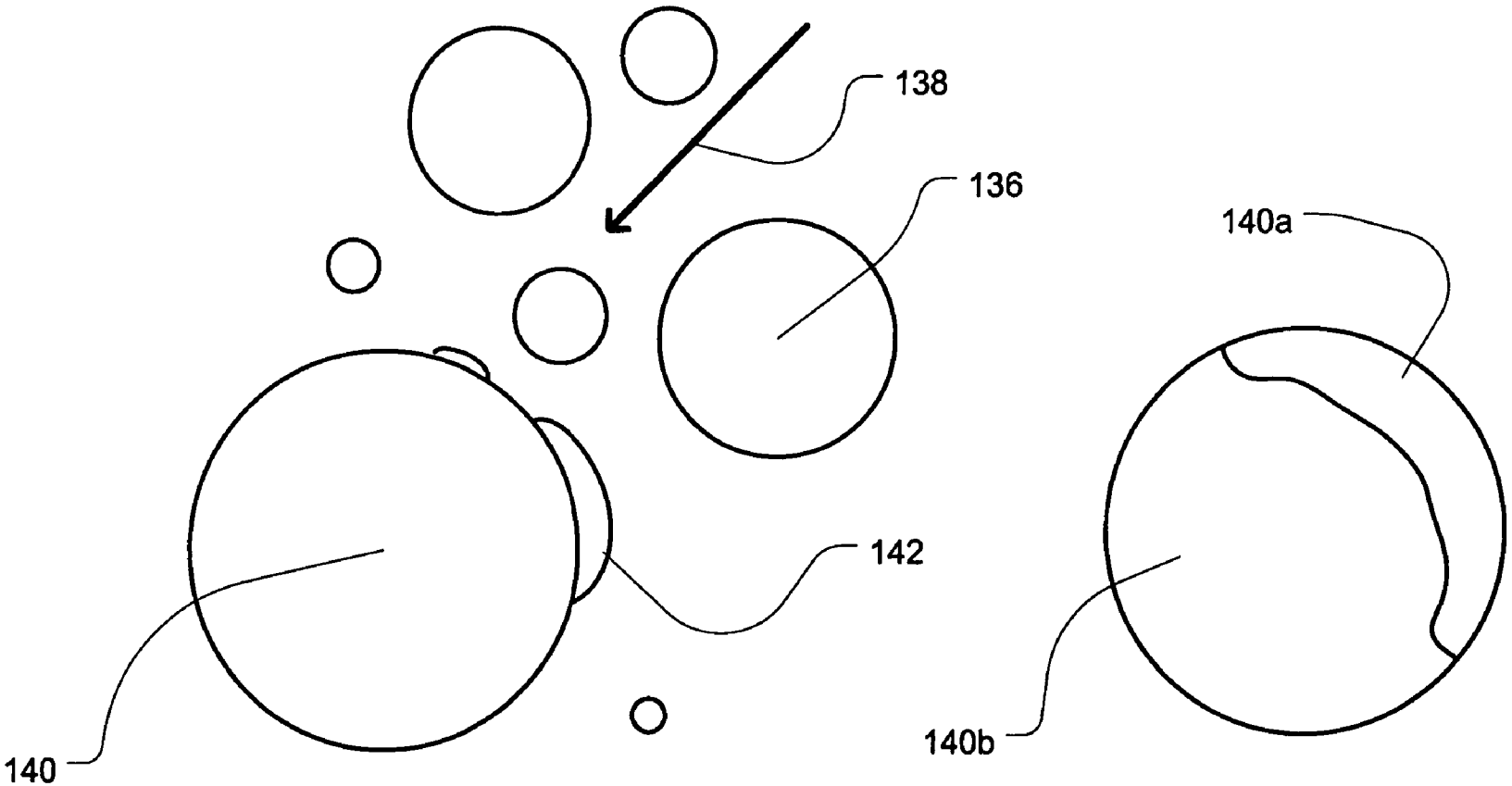
FIGS. 5A and 5B illustrate the effect of the water mist on the polymer fibers prior to their contact with the fiber batt.

As described above, the exemplary embodiments of the present invention are arranged to direct a cooling mist into a spray of hot polymer fibers emitted from a melt-spray head. As illustrated in the fiber cross-sections presented in FIGS. 5A and 5B, it is believed that the droplets 136 of the cooling liquid in the directed mist generally moving in a direction 138 will tend to contact the surface of a hot polymer fiber 140 in an uneven fashion. The droplets that contact the fiber 140 will then be partially or completely evaporated, thereby cooling a portion 140*a* of the fiber while leaving the remainder of the polymer fiber 140*b* at a temperature at which the polymer will remain sufficiently tacky so as to form a strong bond with the fiber batt material and/or other polymer fibers. The hybrid nature of the resulting polymer fibers 140 result in an encapsulating layer that exhibits good adhesion as a result of regions 140*b* and improved surface and material properties provided by the cooled or quenched portions 140*a* of the polymer fiber.

Figures 6A, 6B, 6C:
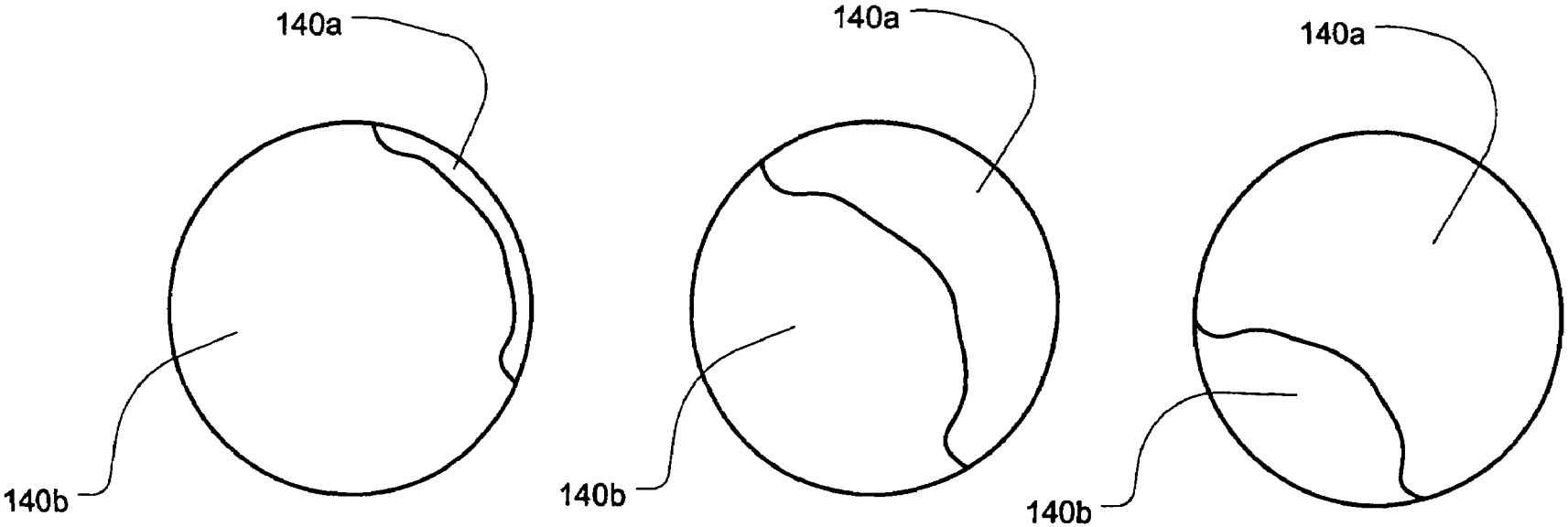
FIGS. 6A–C illustrate the varying effect of the cooling mist on the polymer fibers within the fiber curtain or spray.

As reflected in FIG. 3, the mist of cooling liquid may be configured to enter the fiber spray 112 from only one side. Depending on the volume, velocity and range of droplet size, the cooling mist will not be applied evenly to the fiber spray 112. As illustrated in the fiber cross-sections presented in FIGS. 6A–C, this will tend to result in a mixture of polymer fibers having experienced various degrees of cooling with those fibers passing closer to the source of the cooling mist being cooled more completely, FIG. 6C, while those passing farther away from the source of the cooling mist receiving some intermediate degree of cooling, FIG. 6B, or little if any cooling, FIG. 6A, before reaching the surface of the fiber batt 100. By adjusting the positioning and the properties of the cooling mist, it is possible to control to some degree the properties of the layer formed on the fiber batt whereby fibers that have received the most cooling, and will tend to exhibit the highest strength, may be deposited toward the upper portion of the layer and those fibers that have received the least cooling, and will tend to be the most adhesive, will be deposited toward the lower portions of the layer.

Figures 7A, 7B, 7C:
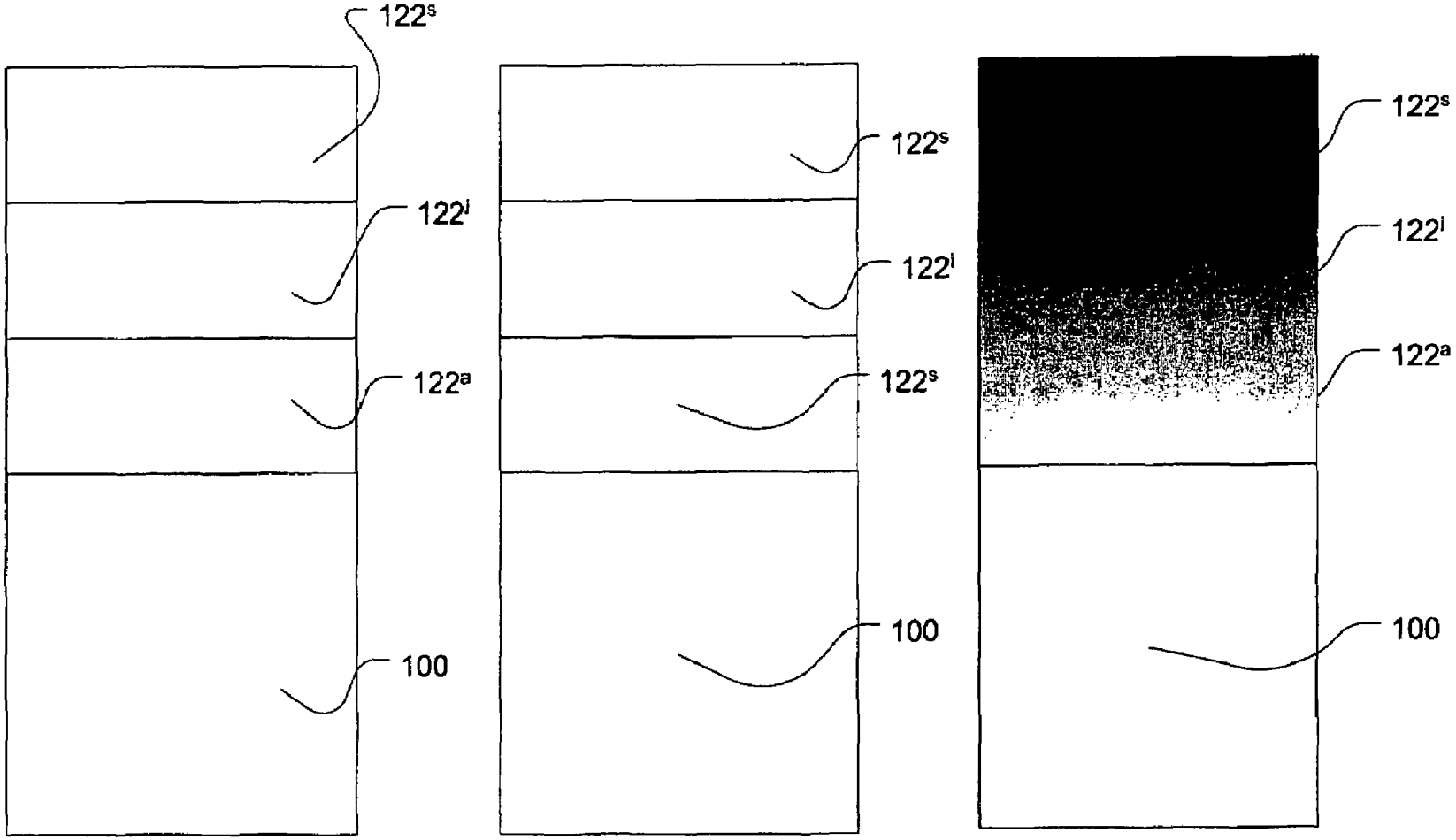
FIGS. 7A–C illustrate variations in the properties of the resulting encapsulating layer as a result of variations in the effect of the cooling liquid mist on the polymer fiber spray.

As illustrated in FIG. 7A, by controlling the penetration of the cooling mist into the fiber spray or curtain 112, layers may be formed that have enhanced strength, 122$^{s}$, intermediate strength and adhesive properties, 122$^{i}$, or enhanced adhesion, 122$^{a}$, relative to the other polymer fibers included in the layer. As illustrated in FIG. 7B, arrangements in which the cooling mist can enter the fiber spray 112 from both sides, two layers having enhanced strength may be formed around a central layer having more intermediate strength and adhesive properties. In such embodiments, because the strength of the lower portion of the layer has been increased at the expense of its adhesive properties, the use of a separate adhesive as illustrated in FIG. 1B may be required to produce a satisfactory product. Although as illustrated in FIGS. 7A and 7B using a multilayered structure, in practice, it is believed that the properties of the individual fibers forming layer 122 may exhibit a more gradual and continuous transition in strength and adhesive properties from top to bottom as illustrated in FIG. 7C.

Figure 8A:
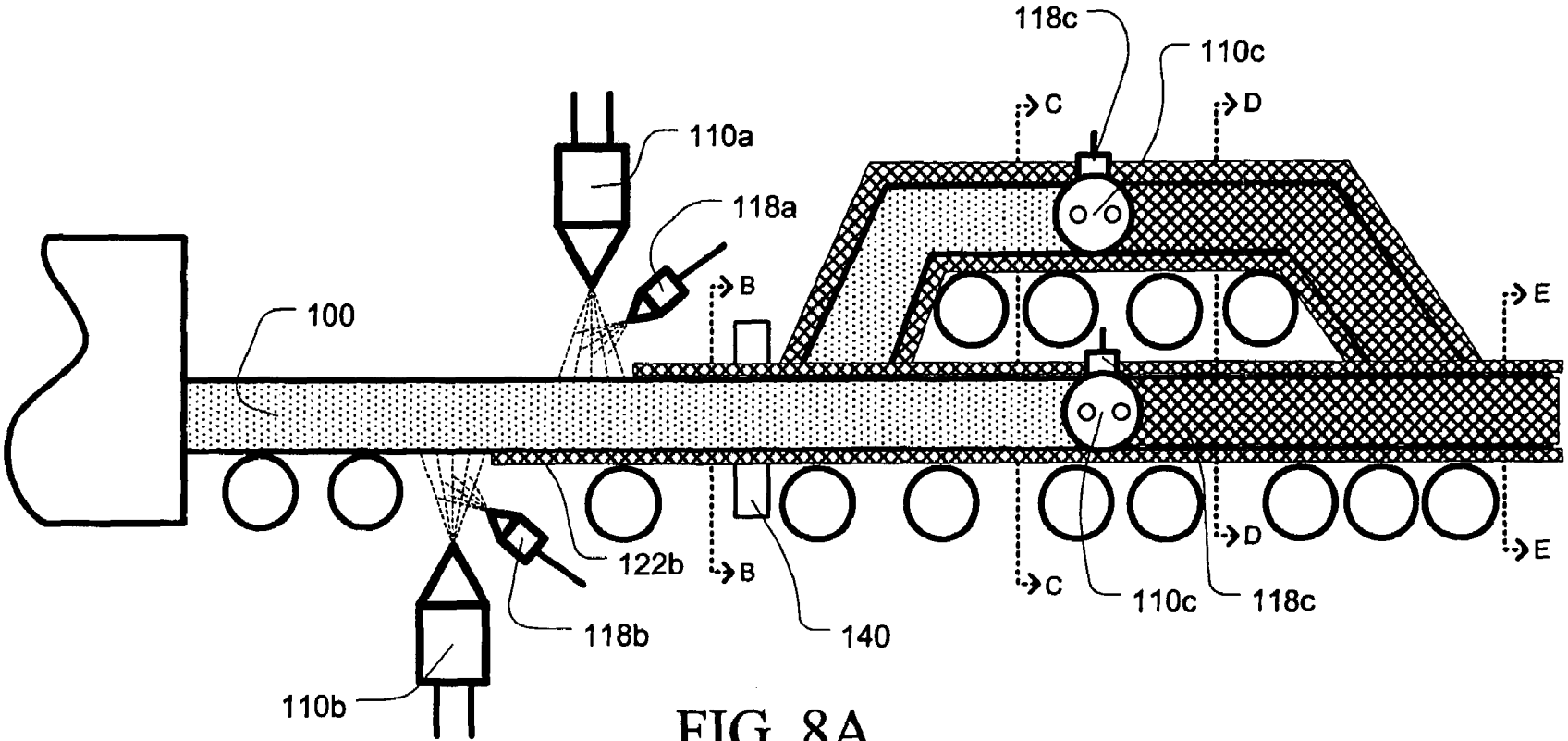
FIGS. 8A–E illustrate a first embodiment of an apparatus for simultaneously manufacturing a plurality of fiber batts.
Figures 8B, 8C, 8D, 8E:
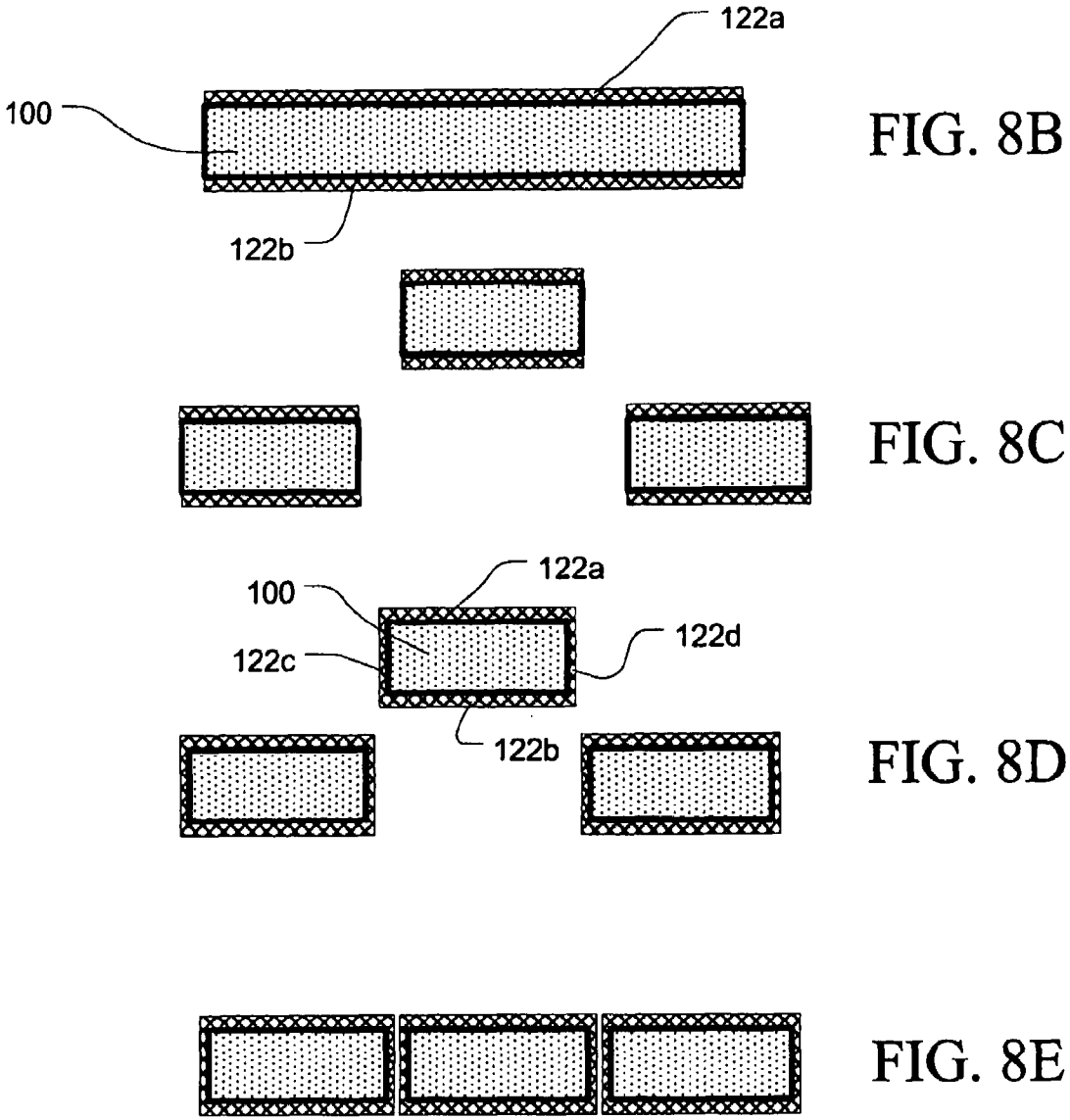

As illustrated in FIG. 8A, a first exemplary embodiment of an apparatus for forming a polymer coating described above may be adapted to accommodate the coating of multiple fiber batts that utilize one of a variety of conveyor assemblies. As illustrated in FIGS. 8A–B, the major surfaces of the primary fiber batt may be coated while the primary fiber batt remains intact. The primary fiber batt may then be separated into a plurality of fiber batts by a series of blades or other cutting tools 140. As illustrated in FIGS. 8A and 8C, after the primary fiber batt has been separated into a plurality of fiber batts, the adjacent fiber batts may be carried on separate conveyors that are arranged to provide vertical separation between adjacent fiber batts.

While the adjacent fiber batts are separated, the minor surfaces of the fiber batts may be coated to complete the encapsulation of the fiber batts as shown in FIG. 8D. After the fiber batts have been coated and the encapsulating layers are sufficiently set, the individual batts may once again be conveyed in a generally planar relationship as illustrated in FIG. 8E and be fed to additional processing steps such as chopping, rolling and/or bagging (not shown). It will also be appreciated that although the exemplary embodiments illustrated in FIGS. 8–12 include only three secondary fiber batts, the basic principles and apparatus are not so limited and may be applied to manufacture any practical number of fiber batts.

A variety of techniques may used, either singly or in combination, to separate the secondary fiber batts for individual processing. The specific technique(s) utilized may depend on a variety of factors including, for example, the number of secondary batts, the speed at which the batts are advanced through the apparatus, the type of processing to be completed while the secondary fiber batts are separated and the physical space in which the encapsulating apparatus must be placed. In each instance, however, the goal of the separation techniques is to reduce or eliminate interference between the adjacent fiber batts and the processing equipment necessary to process one or more of the unencapsulated surfaces of the fiber batts.

Figure 9A:
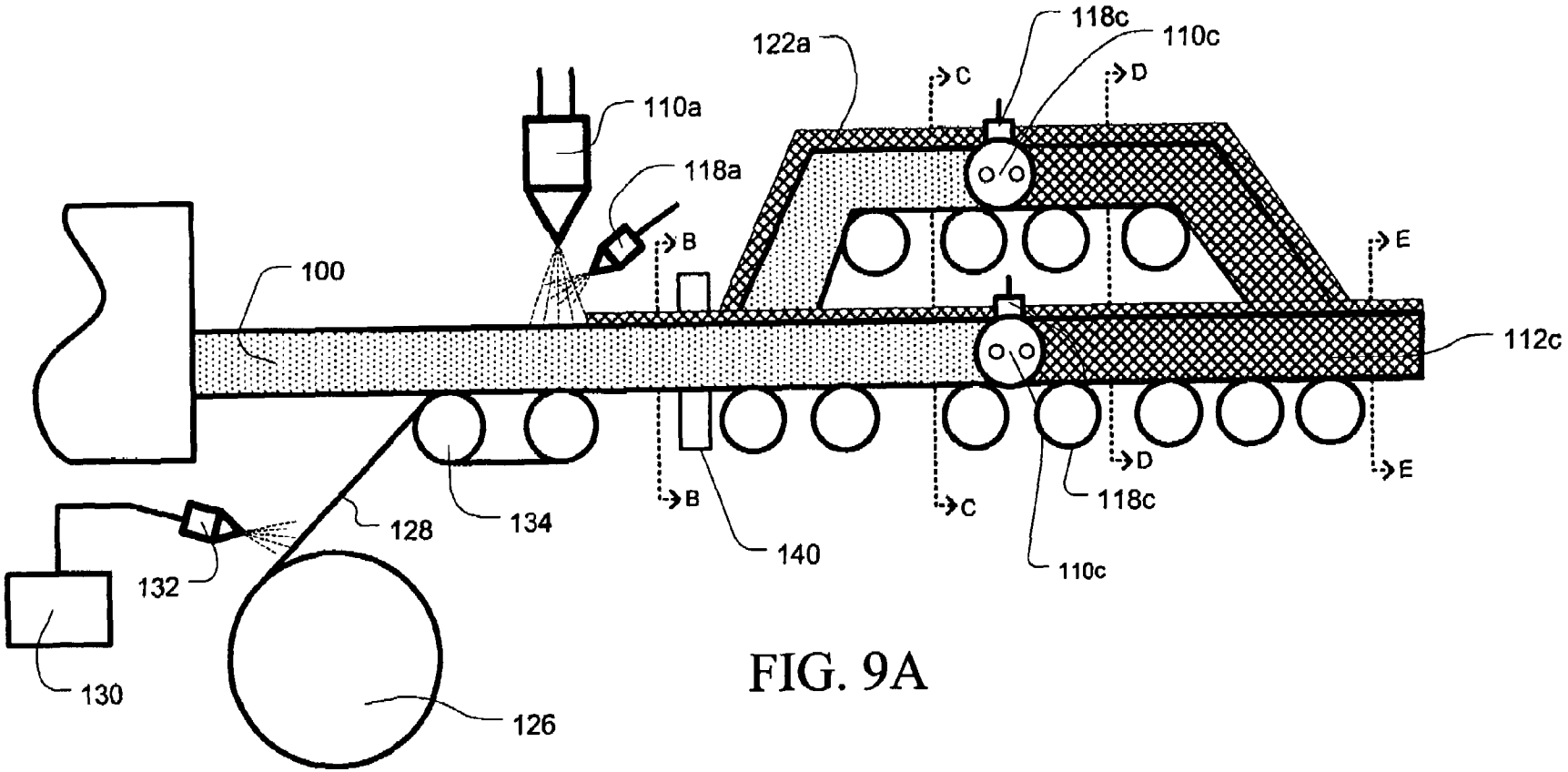
FIGS. 9A–E illustrate a second embodiment of an apparatus for simultaneously manufacturing a plurality of fiber batts.
Figures 9B, 9C, 9D, 9E:
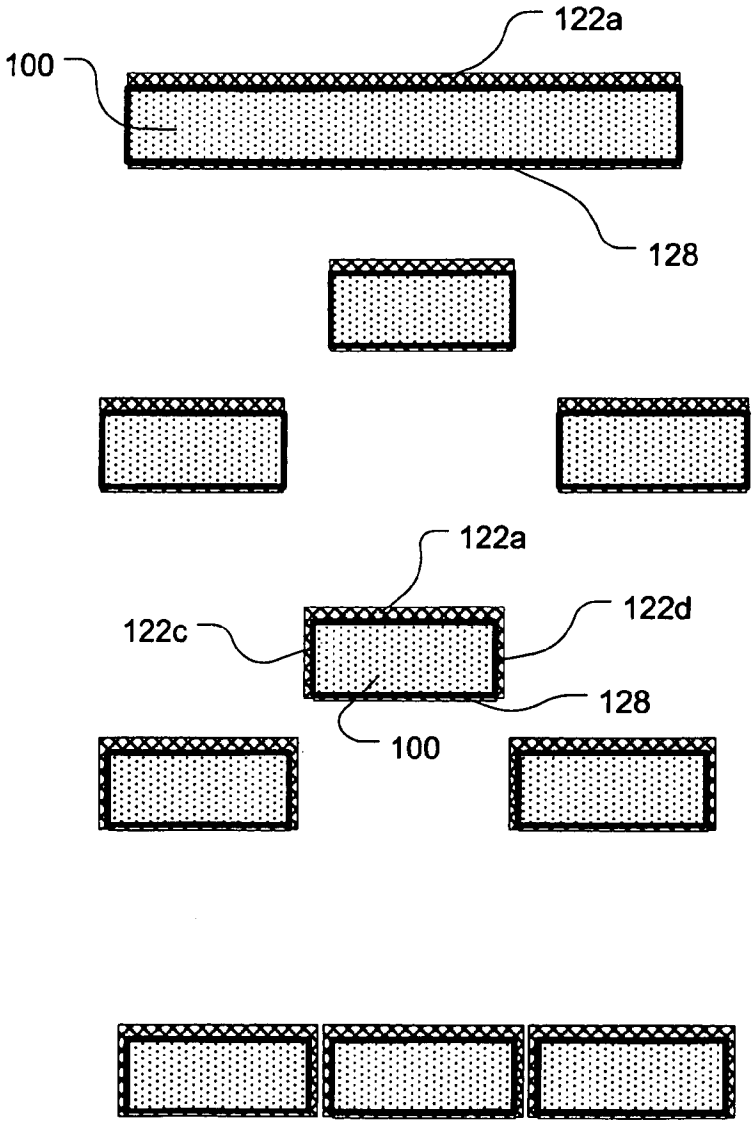

As illustrated in FIG. 9A, a second exemplary embodiment of an apparatus for forming a polymer coating described above may be adapted to accommodate the coating of multiple fiber batts that utilize one of a variety of conveyor assemblies. As illustrated in FIGS. 9A–B, one of the major surfaces of the primary fiber batt may be coated with a melt-blown layer while a vapor retarding layer or other type of premanufactured sheet product 128 is applied to the other major surface while the primary fiber batt remains intact. The primary fiber batt may then be separated into a plurality of fiber batts by a series of blades or other cutting tools 140. It will be appreciated that for applications in which excess sheet material is desired for forming, for example, attachment flanges or partial attachment to adjacent surfaces, the sheet products may be individually applied to the secondary batts (not shown). As illustrated in FIGS. 9A and 9C, after the primary fiber batt has been separated into a plurality of fiber batts, the adjacent fiber batts may be carried on separate conveyors that are arranged to provide vertical separation between adjacent fiber batts.

While the adjacent fiber batts are separated, the minor surfaces of the fiber batts may be coated to complete the encapsulation of the fiber batts as shown in FIG. 9D. After the fiber batts have been coated and the encapsulating layers are sufficiently set, the individual batts may once again be conveyed in a generally planar relationship as illustrated in FIG. 9E and be fed to additional processing steps such as chopping, rolling and/or bagging (not shown).

Figure 10A:
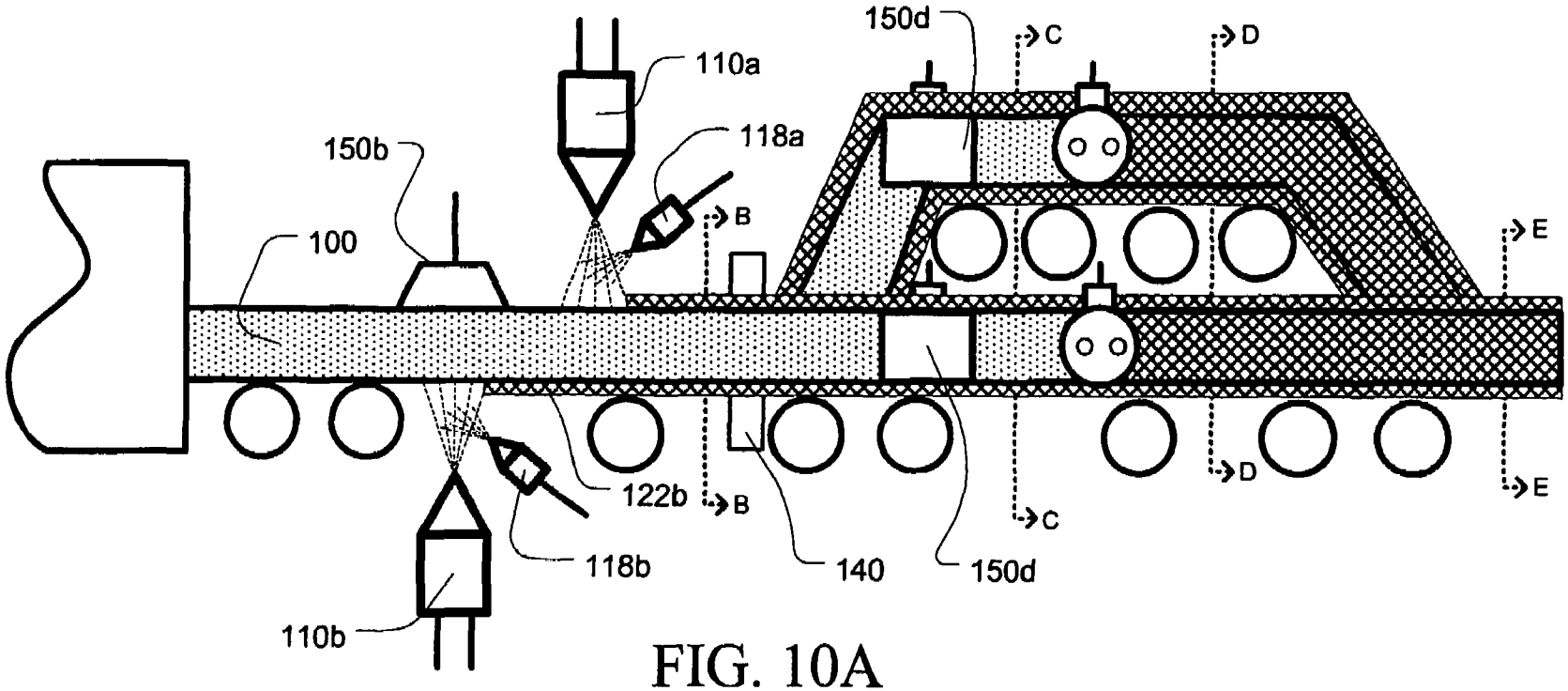
FIGS. 10A–E illustrate a third embodiment of an apparatus for simultaneously manufacturing a plurality of fiber batts.
Figure 10B:
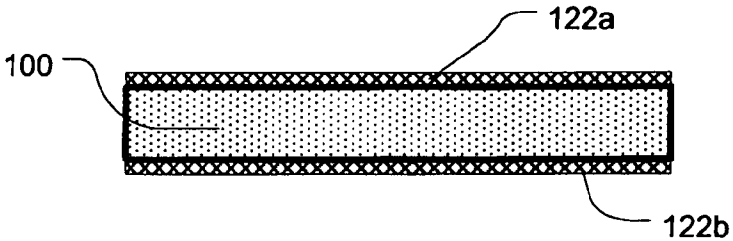
Figure 10C:
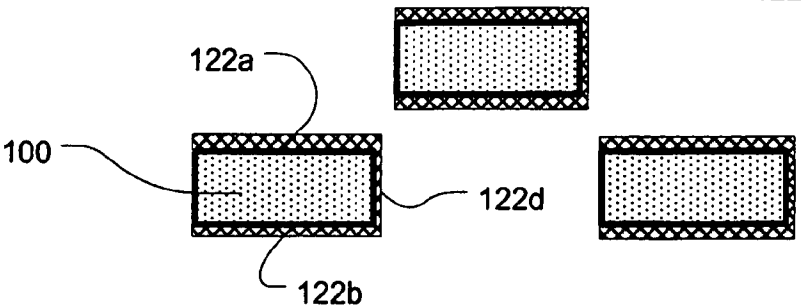

As illustrated in FIG. 10A, a third exemplary embodiment of an apparatus for forming a polymer coating described above may be adapted to accommodate the coating of multiple fiber batts that utilize one of a variety of conveyor assemblies. As illustrated in FIGS. 10A–B, the major surfaces of the primary fiber batt may be coated while the primary fiber batt remains intact. The primary fiber batt may then be separated into a plurality of fiber batts by a series of blades or other cutting tools 140. As illustrated in FIGS. 10A and 10C, after the primary fiber batt has been separated into a plurality of fiber batts, the adjacent fiber batts may be carried on separate conveyors that are arranged to provide vertical separation between adjacent fiber batts. As further illustrated in FIG. 10A, vacuum devices 150*b*, 150*d* may be arranged adjacent the surface of the fiber batt 100 opposite the surface to which the encapsulating layer is being applied by the melt-blowing assemblies.

Figure 10D:
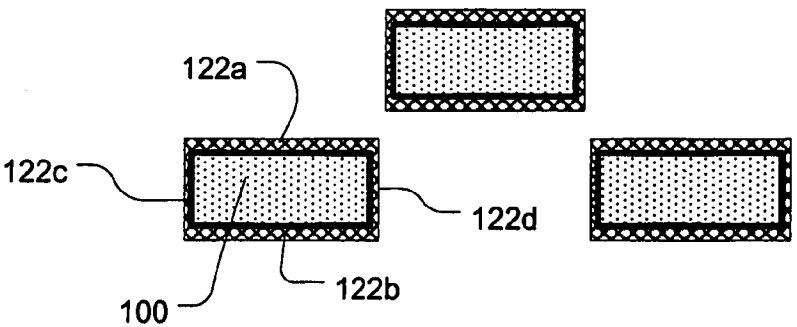
Figure 10E:
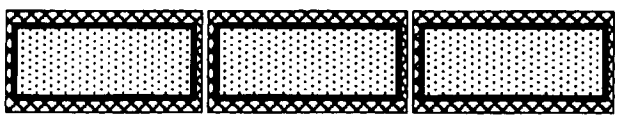

While the adjacent fiber batts are separated, a first one of the minor surfaces of the fiber batts may be coated with a melt blown fiber layer as shown in FIG. 10C. The other minor surface of the fiber batts may then subsequently be coated to complete the encapsulation of the fiber batts as illustrated in FIG. 10D. After the fiber batts have been completely coated and the encapsulating layers are sufficiently set, the individual batts may once again be conveyed in a generally planar relationship as illustrated in FIG. 10E and be fed to additional processing steps such as chopping, rolling and/or bagging (not shown).

Figure 11A:
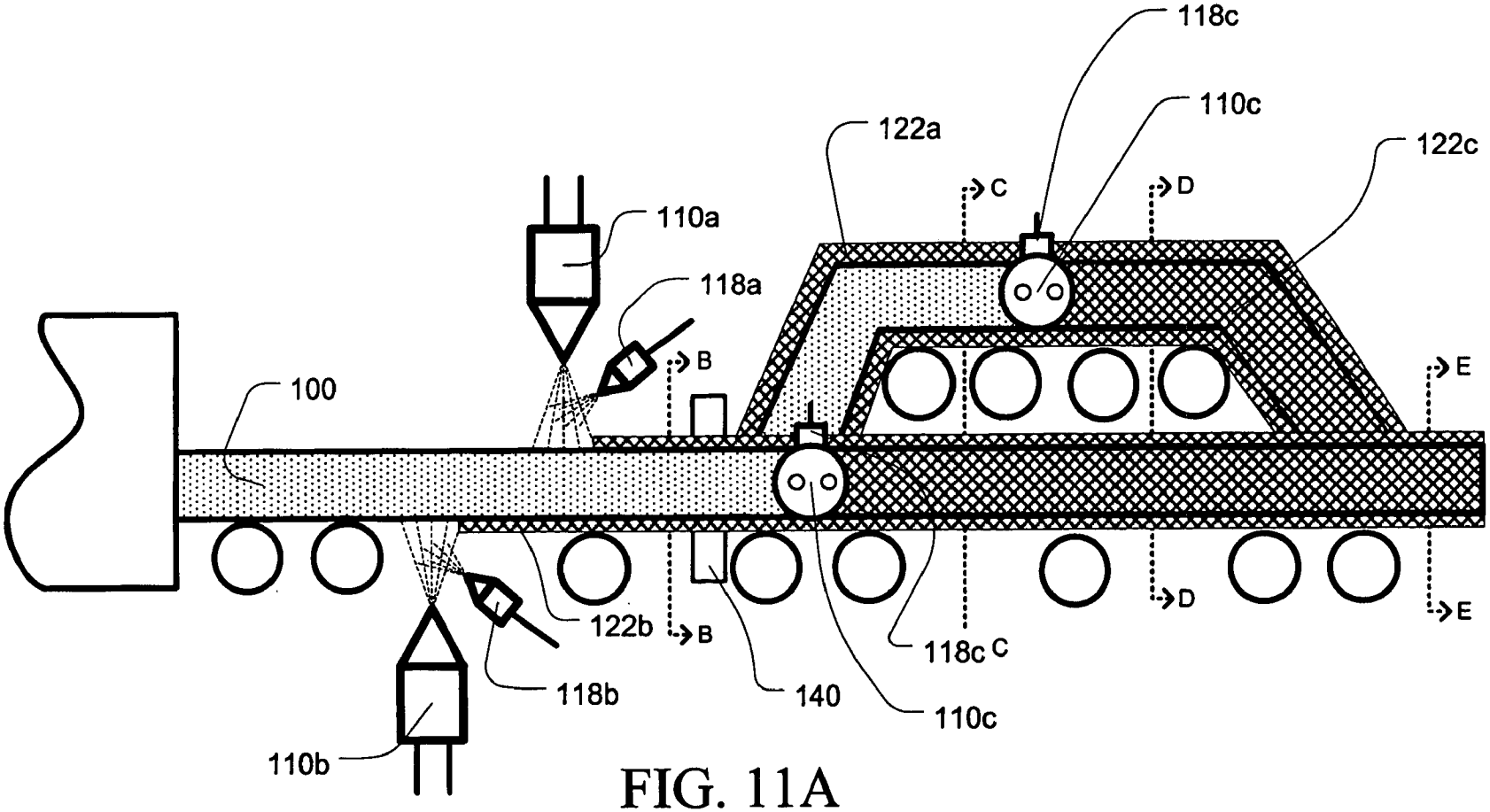
FIGS. 11A–E illustrate a fourth embodiment of an apparatus for simultaneously manufacturing a plurality of fiber batts.
Figure 11B:
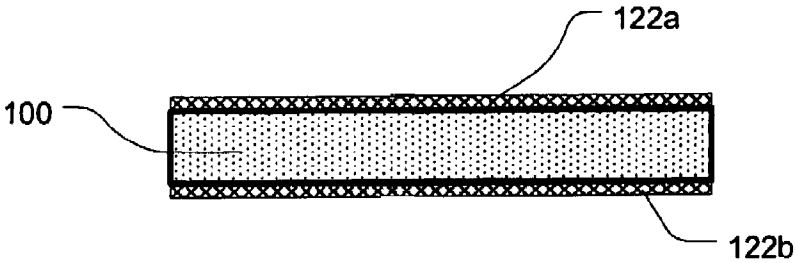

As illustrated in FIG. 11A, a fourth exemplary embodiment of an apparatus for forming a polymer coating described above may be adapted to accommodate the coating of multiple fiber batts that utilize one of a variety of conveyor assemblies. As illustrated in FIGS. 11A–B, the major surfaces of the primary fiber batt may be coated while the primary fiber batt remains intact. The primary fiber batt may then be separated into a plurality of fiber batts by a series of blades or other cutting tools 140. As illustrated in FIG. 11A, after the primary fiber batt has been separated into a plurality of fiber batts, the adjacent fiber batts may be carried on separate conveyors that are arranged to provide vertical separation between adjacent fiber batts that may be designated as upper batt(s) and lower batt(s) to indicate their relative vertical position. Although the illustrated embodiment illustrates separation achieved by "raising" certain of the fiber batts relative to the primary fiber batt, it will be appreciated that the necessary separation may also be achieved by lowering certain of the fiber batts or by a combination of both raising and lowering adjacent batts.

Figure 11C:
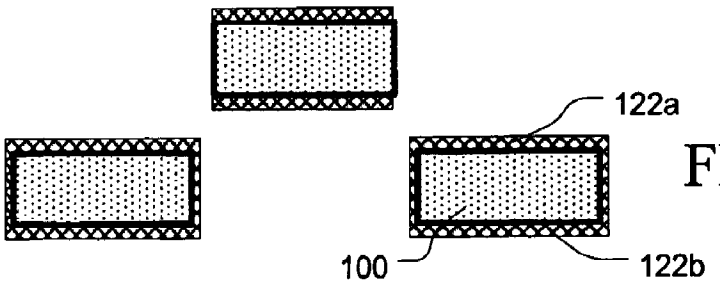
Figure 11D:
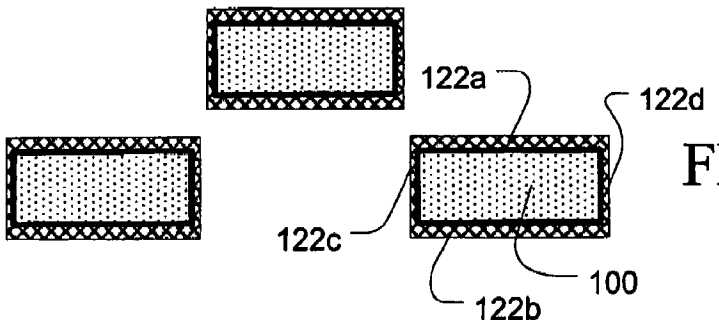
Figure 11E:
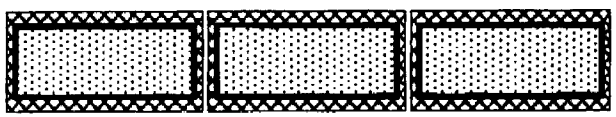

While the adjacent fiber batts are separated, the minor surfaces of one group of fiber batts may be coated with a melt blown layer to complete the encapsulation of those fiber batts as illustrated in FIG. 11C in which the "lower" batts are encapsulated. Subsequent to the encapsulation of the first group of fiber batts, the minor surfaces of a second group of fiber batts, which may include all remaining batts, may be coated with a melt blown layer to complete their encapsulation as illustrated in FIG. 11D. After both the upper and lower fiber batts have been completely coated and the encapsulating layers are sufficiently set, the individual batts may once again be conveyed in a generally planar relationship as illustrated in FIG. 11E and be fed to additional processing steps such as chopping, rolling and/or bagging (not shown).

Figure 12A:
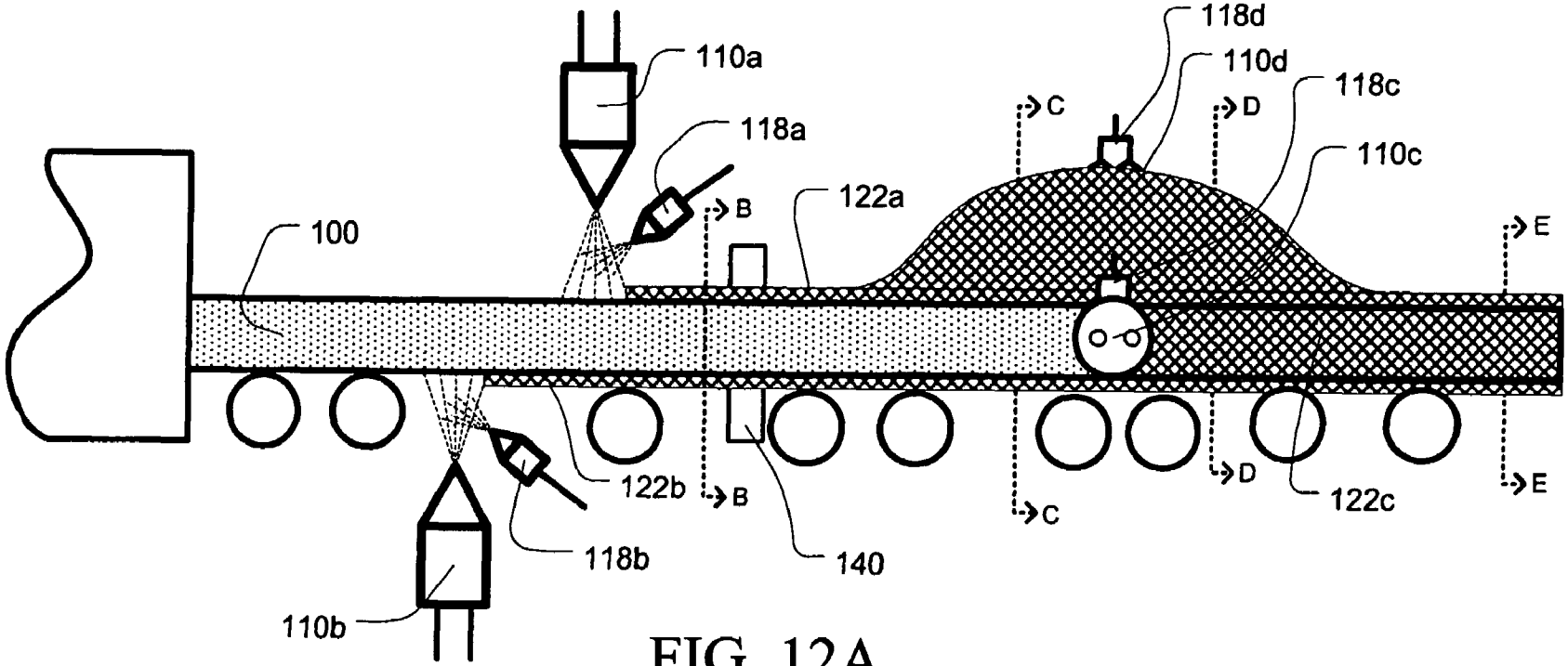
FIGS. 12A–I illustrate fifth, sixth and seventh embodiments of an apparatus for simultaneously manufacturing a plurality of fiber batts.
Figure 12B:
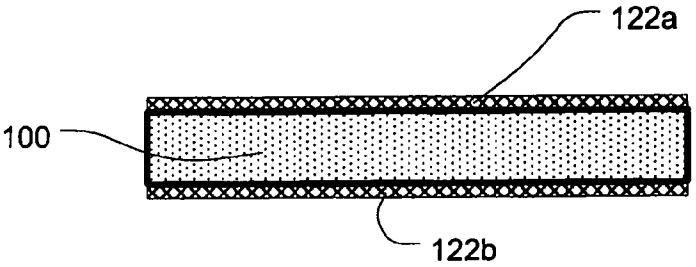
Figure 12C:
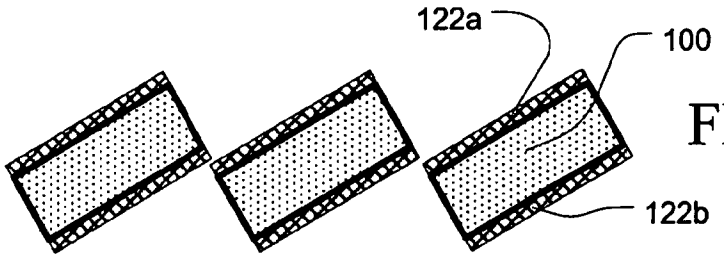

As illustrated in FIG. 12A, a fifth exemplary embodiment of an apparatus for forming a polymer coating described above may be adapted to accommodate the coating of multiple fiber batts that utilize one of a variety of conveyor assemblies. As illustrated in FIGS. 12A and 12B, the major surfaces of the primary fiber batt may be coated while the primary fiber batt remains intact. The primary fiber batt may then be separated into a plurality of fiber batts by a series of blades or other cutting tools 140. As illustrated in FIG. 12C, after the primary fiber batt has been separated into a plurality of fiber batts, the adjacent fiber batts may be carried on separate conveyors that are arranged to rotate the fiber batts to a degree sufficient to expose the minor surfaces of adjacent fiber batts.

Figure 12D:
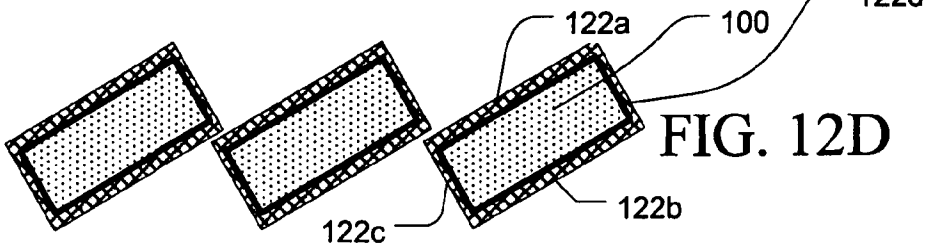
Figure 12E:
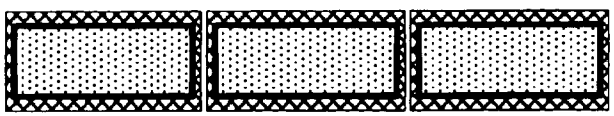

Although the illustrated embodiment illustrates only a rotational movement of the fiber batts, it will be appreciated that the necessary separation may also be achieved through a combination of rotation and vertical separation as utilized in the exemplary embodiments previously described. While the minor surfaces of the adjacent fiber batts are exposed, the minor surfaces of the fiber batts may be coated with a melt blown layer to complete the encapsulation of those fiber batts as illustrated in FIG. 12D. After the fiber batts have been completely coated and the encapsulating layers are sufficiently set, the individual batts may once again be conveyed in a generally planar relationship as illustrated in FIG. 12E and be fed to additional processing steps such as chopping, rolling and/or bagging (not shown).

Figure 12F:
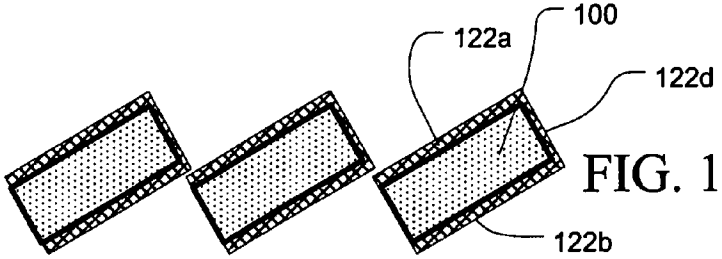
Figure 12G:
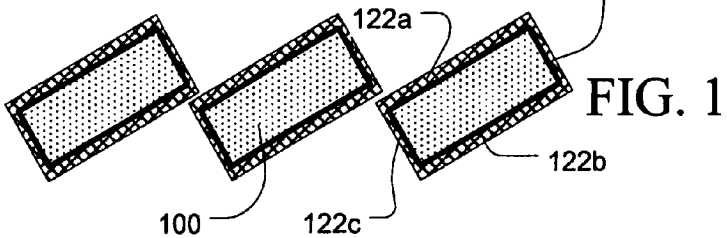

As illustrated in FIGS. 12F–G, a sixth exemplary embodiment of an apparatus for forming a polymer coating described above may be adapted to accommodate the coating of multiple fiber batts that utilize one of a variety of conveyor assemblies. Although generally corresponding to the fifth embodiment illustrated in FIGS. 12A–E, in this embodiment the minor surfaces of the adjacent batts are coated sequentially rather than generally simultaneously.

Figure 12H:
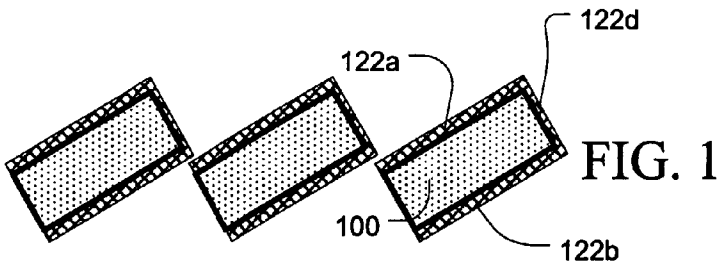
Figure 12I:
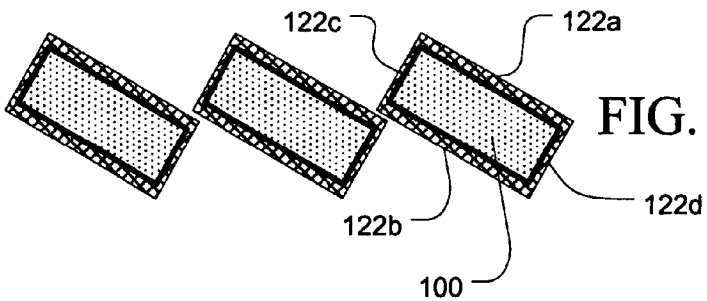

As illustrated in FIGS. 12H–I, a seventh exemplary embodiment of an apparatus for forming a polymer coating described above may be adapted to accommodate the coating of multiple fiber batts that utilize one of a variety of conveyor assemblies. Although generally corresponding to the sixth embodiment illustrated in FIGS. 12F–G, in this embodiment the minor surfaces of the adjacent batts are coated sequentially rather than generally simultaneously and, in addition, the direction of the rotation of the fiber batts is reversed before the second of the minor surfaces is coated to complete the encapsulation of the fiber batts. Although, as illustrated, the more upwardly facing minor surface of the fiber batt is being coated, it will be appreciated that the coating sequence may be reversed to limit the overspray onto the previously coated surfaces or provide other processing advantages.

Figure 13A:
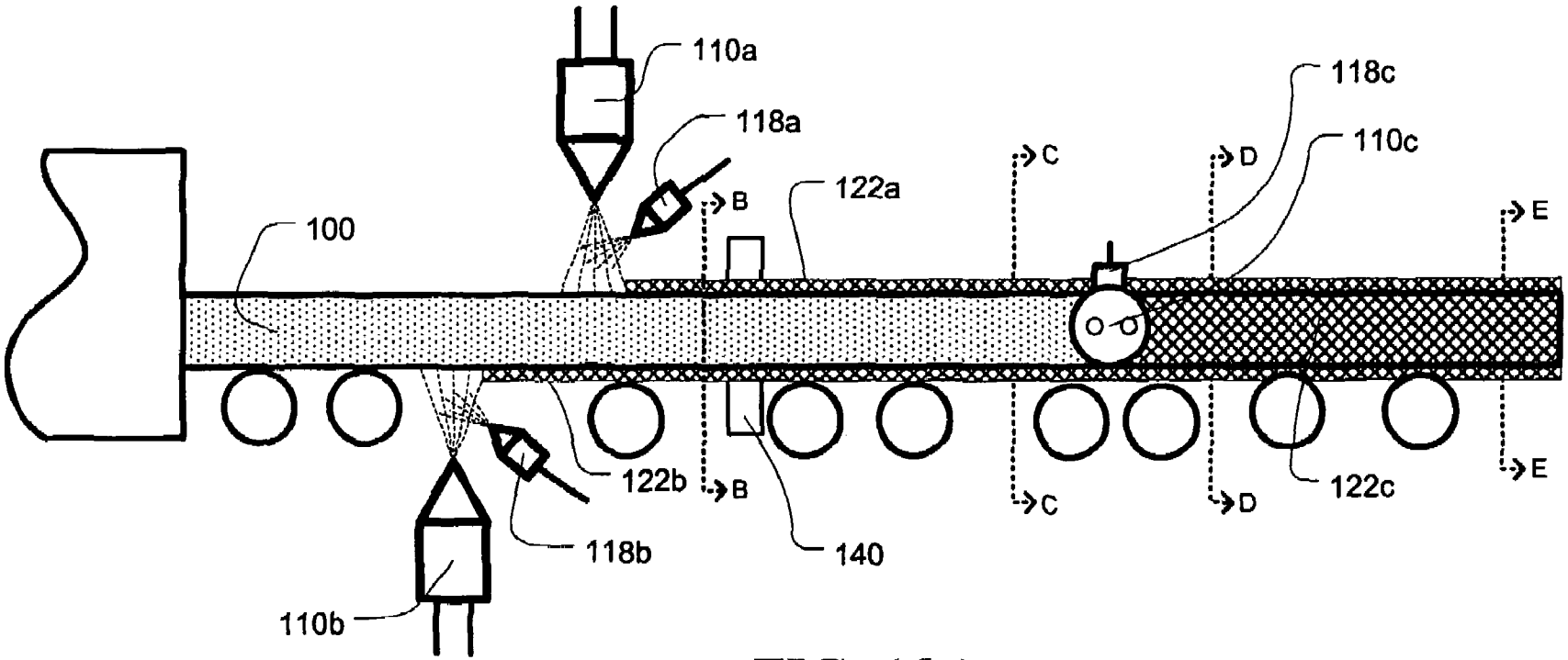
FIGS. 13A–E illustrate an eighth embodiment of an apparatus for simultaneously manufacturing a plurality of fiber batts.
Figure 13B:
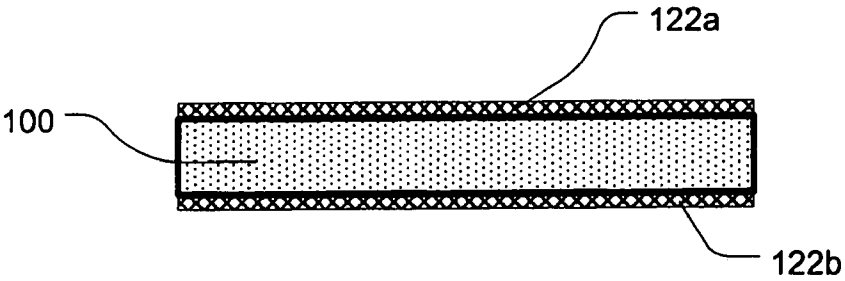
Figure 13C:
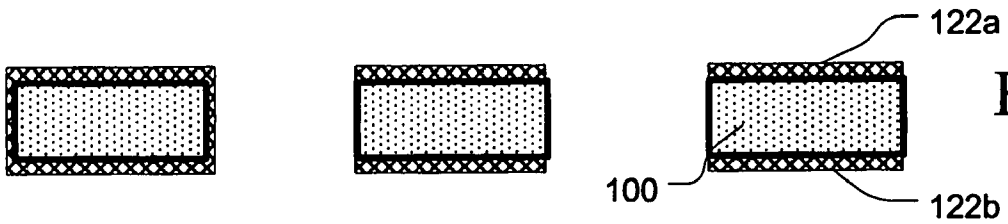

As illustrated in FIG. 13A, an eighth exemplary embodiment of an apparatus for forming a polymer coating described above may be adapted to accommodate the coating of multiple fiber batts that utilize one of a variety of conveyor assemblies. As illustrated in FIGS. 13A and 13B, the major surfaces of the primary fiber batt may be coated while the primary fiber batt remains intact. The primary fiber batt may then be separated into a plurality of fiber batts by a series of blades or other cutting tools 140. As illustrated in FIGS. 13A and 13C, after the primary fiber batt has been separated into a plurality of fiber batts, the adjacent fiber batts may be carried on separate conveyors that are arranged to increase the horizontal separation between adjacent fiber batts.

Figure 13D:
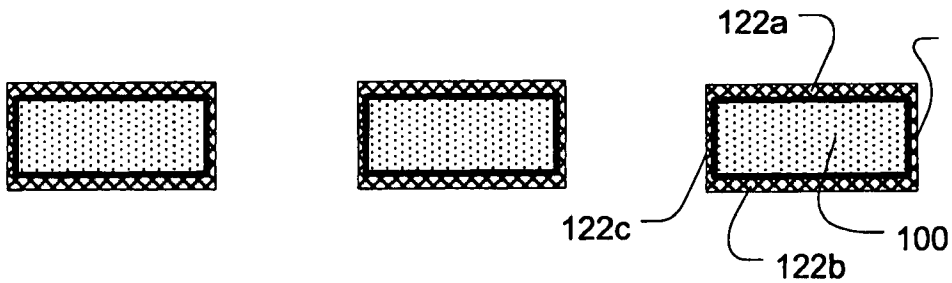
Figure 13E:
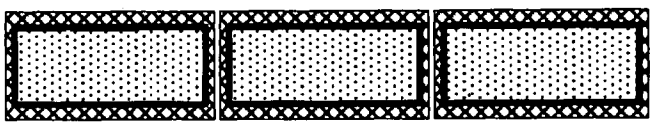

While the adjacent fiber batts are separated, the minor surfaces of the fiber batts may be coated to complete the encapsulation of the fiber batts as shown in FIG. 13D. After the fiber batts have been coated and the encapsulating layers are sufficiently set, the individual batts may once again be conveyed in a more closely spaced and generally planar relationship as illustrated in FIG. 13E and be fed to additional processing steps such as chopping, rolling and/or bagging (not shown). It will also be appreciated that although the exemplary embodiments illustrated in FIGS. 8–13 include only three secondary fiber batts, the basic principles and apparatus are not so limited and may be applied to manufacture any practical number of fiber batts.

While the present invention has been particularly shown and described with reference to exemplary embodiments thereof, it will be understood by those of ordinary skill in the art that various changes in form and details may be made therein without departing from the spirit and scope of the present invention as defined by the following claims. In particular, it will be appreciated that a range of known conveying mechanisms may be used to achieve the desired positioning and movement of the fiber batt or batts as they advance through the apparatus. Similarly, it will be appreciated that the sequence and timing for coating the various surfaces of the fiber batts may be modified to accommodate a wide range of fiber and coating material combinations.

We claim:

1. A method of forming an encapsulated fiber batt comprising:

conveying a fiber batt in a first direction, the fiber batt having a first and second major surfaces and two minor surfaces, the major surfaces having a substantially horizontal orientation; and passing the fiber batt past a melt-blowing assembly, the melt-blowing assembly being arranged and configured to extrude a polymer melt and a hot gas stream, the hot gas stream being directed to impact the extruded polymer melt at a volume and at a velocity sufficient to cause attenuation of the polymer melt into polymer melt fibers and to direct the fibers toward a surface of the fiber batt;

the melt-blowing assembly further being arranged and configured to apply a cooling fluid to the polymer melt fibers at a volume and a temperature sufficient to quench a surface portion of a portion of the polymer melt fibers before the polymer melt fibers contact a surface of the fiber batt, the polymer melt fibers retaining sufficient heat to adhere to the fiber batt or other polymer fibers.

2. A method of foaming an encapsulated fiber batt according to claim 1, wherein;

the polymer melt includes at least one polymer selected from a group consisting of polypropylene (PP), polyethylene (PE), ethylene-propylene copolymer, polyester, polyethylene terephthalate (PET), nylon or ethylene/vinyl acetate (EVA).

3. A method of forming an encapsulated fiber batt according to claim 1, wherein:

the polymer melt fibers are deposited on the first major surface and both minor surfaces.

4. A method of forming an encapsulated fiber batt according to claim 1, wherein:

the polymer melt fibers are deposited on the first and the second major surfaces and both minor surfaces.

5. A method of forming an encapsulated fiber batt according to claim 3, further comprising:

attaching a premanufactured sheet material to the second major surface.

6. A method of forming an encapsulated fiber batt according to claim 5, wherein:

attaching the sheet material includes dispensing a vapor retarding layer from a vapor retarder supply;

applying an adhesive to a first surface of the vapor retarding layer;

forcing the first surface of the vapor retarding layer against the second major surface of the fiber batt at an application pressure and for an application time period sufficient to adhere the vapor retarding layer to the fiber batt.

7. A method of forming an encapsulated fiber batt according to claim 6, wherein:

the adhesive includes a hot-melt adhesive and is applied to the first surface by ejecting a stream liquid hot-melt adhesive through a nozzle toward the vapor retarding layer.

8. A method of forming an encapsulated fiber batt according to claim 7, wherein:

the nozzle is a melt-blowing assembly.

9. A method of forming an encapsulated fiber batt according to claim 2, wherein:

the polymer melt fibers are applied to the fiber batt at a first rate measured in mass per batt area; and the cooling fluid is applied to the polymer melt fibers at a second rate measured in mass per batt area, wherein a ratio of the second rate to the first rate is no less than 1:20.

10. A method of forming an encapsulated fiber batt according to claim 1, wherein:

the cooling fluid is a cooling liquid.

11. A method of forming an encapsulated fiber batt according to claim 10, wherein:

the cooling liquid is water, the water being applied to the polymer fibers as a water mist.

12. A method of forming an encapsulated fiber batt according to claim 11, wherein:

the water mist includes water droplets having an average droplet diameter;

the polymer fibers have an average fiber diameter; and the ratio of the average droplet diameter to the average fiber diameter is between about 2:1 to 1:10.

13. A method of forming an encapsulated fiber batt according to claim 11, wherein:

the water mist is substantially converted to water vapor before the polymer fibers are deposited on the fiber batt.

14. A method of forming an encapsulated fiber batt according to claim 5, wherein:

the sheet material is selected from a group consisting of vapor retarding layers, kraft paper, vapor permeable layers and liquid permeable layers.

15. A method of forming a plurality of encapsulated fiber batts comprising:

conveying a primary fiber batt in a first direction, the fiber batt having a first and second major surfaces and two minor surfaces, the major surfaces having a substantially horizontal orientation;

passing the primary fiber batt past first melt-blowing assemblies, the first melt-blowing assemblies being arranged and configured to extrude a polymer melt and a hot gas stream, the hot gas stream being directed to impact the extruded polymer melt at a volume and at a velocity sufficient to cause attenuation of the polymer melt into polymer melt fibers and to direct the fibers toward the major surfaces of the primary fiber batt;

the first melt-blowing assemblies further being arranged and configured to apply a cooling fluid to the polymer melt fibers at a volume and a temperature sufficient to quench a surface portion of a portion of the polymer melt fibers before the polymer melt fibers contact a surface of the fiber batt, the polymer melt fibers retaining sufficient heat to adhere to the fiber batt or other polymer fibers;

separating the primary fiber batt into a plurality of secondary fiber batts, each of the secondary fiber batts including first and second major surfaces and first and second minor surfaces, wherein the first and second minor surfaces of adjacent batts are opposed;

separating the opposed surfaces of adjacent secondary fiber batts to expose the minor surfaces of the secondary fiber batts;

passing the exposed minor surfaces of the secondary fiber batts past second melt-blowing assemblies, the second melt-blowing assemblies being arranged and configured to extrude a polymer melt and a hot gas stream, the hot gas stream being directed to impact the extruded polymer melt at a volume and at a velocity sufficient to cause attenuation of the polymer melt into polymer melt fibers and to direct the fibers toward the exposed minor surfaces of the secondary fiber batts;

the second melt-blowing assemblies further being arranged and configured to apply a cooling fluid to the polymer melt fibers at a volume and a temperature sufficient to quench a surface portion of a portion of the polymer melt fibers before the polymer melt fibers contact a surface of the fiber batt, the polymer melt fibers retaining sufficient heat to adhere to the fiber batt or other polymer fibers;

thereby encapsulating each of the secondary fiber batts.

16. A method of forming a plurality of encapsulated fiber batts according to claim 15, wherein:

separating the opposed surfaces of adjacent secondary fiber batts to expose the minor surfaces of the secondary fiber batts includes raising a first group of the secondary fiber batts relative to a second group of the secondary fiber batts.

17. A method of forming a plurality of encapsulated fiber batts according to claim 15, wherein separating the opposed surfaces of adjacent secondary fiber batts to expose the minor surfaces of the secondary fiber batts includes lowering a first group of the secondary fiber batts relative to a second group of the secondary fiber batts.

18. A method of forming a plurality of encapsulated fiber batts according to claim 15, wherein:

separating the opposed surfaces of adjacent secondary fiber batts to expose the minor surfaces of the secondary fiber batts includes raising a first group of the secondary fiber batts relative to the primary fiber batt and lowering a second group of the secondary fiber batts relative to the primary fiber batt.

19. A method of forming a plurality of encapsulated fiber batts according to claim 15, wherein:

separating the opposed surfaces of adjacent secondary fiber batts to expose the minor surfaces of the secondary fiber batts includes rotating the secondary fiber batts in a first rotational direction.

20. A method of forming a plurality of encapsulated fiber batts according to claim 19, wherein:

separating the opposed surfaces of adjacent secondary fiber batts to expose the minor surfaces of the secondary fiber batts includes rotating the secondary fiber batts in a first rotational direction and subsequently rotating the secondary fiber batts in a second rotational direction, the second rotational direction being opposite the first rotational direction.

21. A method of forming a plurality of encapsulated fiber batts according to claim 15, wherein:

separating the opposed surfaces of adjacent secondary fiber batts to expose the minor surfaces of the secondary fiber batts includes increasing the horizontal spacing between adjacent secondary fiber batts.

22. A method of forming a plurality of encapsulated fiber batts according to claim 15, wherein:

passing the exposed minor surfaces of the secondary fiber batts past second melt-blowing assemblies includes passing the first minor surfaces of the secondary fiber batts past a first portion of the second melt-blowing assemblies;

conveying the secondary fiber batts an additional distance in the first direction; and then passing the second minor surfaces of the secondary fiber batts past a second portion of the second melt-blowing assemblies to complete the encapsulation of the secondary fiber batts.

23. A method of forming a plurality of encapsulated fiber batts according to claim 15, wherein:

passing the exposed minor surfaces of the secondary fiber batts past second melt-blowing assemblies includes passing the exposed minor surfaces of a first group of the secondary fiber batts past a first portion of the second melt-blowing assemblies to complete the encapsulation of the first group of secondary fiber batts;

conveying the secondary fiber batts an additional distance in the first direction; and then passing the exposed minor surfaces of a second group of the secondary fiber batts past a second portion of the second melt-blowing assemblies to complete the encapsulation of the second group of the secondary fiber batts.

* * * * *